US005836039A

United States Patent [19]

Rimer

[11] Patent Number: 5,836,039

[45] Date of Patent: Nov. 17, 1998

[54] COLLAPSIBLE MOP PAD HOLDER

[75] Inventor: Alf Rimer, Herley, Denmark

[73] Assignee: DIT International HQ A/S, Lynge, Denmark

[21] Appl. No.: 432,149

[22] PCT Filed: Nov. 5, 1993

[86] PCT No.: PCT/DK93/00360

§ 371 Date: Jun. 28, 1995

§ 102(e) Date: Jun. 28, 1995

[87] PCT Pub. No.: WO94/09692

PCT Pub. Date: May 11, 1994

[30] Foreign Application Priority Data

Nov. 5, 1992 [DK] Denmark ..... 1349/92

[51] Int. Cl.[6] ..... A47L 13/10; A47L 13/16; A47L 13/255

[52] U.S. Cl. ..... 15/228; 15/147.2; 15/229.8

[58] Field of Search ..... 15/147.1, 174.2, 15/228, 229.1, 229.2, 229.3, 229.4, 229.6, 229.7, 229.8

[56] References Cited

U.S. PATENT DOCUMENTS

| | | | |
|---|---|---|---|
| 1,344,936 | 6/1920 | Beaudet . | |
| 3,029,454 | 4/1962 | Short et al. . | |
| 3,324,495 | 6/1967 | Van Schwartz . | |
| 3,864,782 | 2/1975 | Carter . | |
| 4,748,710 | 6/1988 | Jones . | |
| 4,912,804 | 4/1990 | Pasbol . | |
| 5,390,390 | 2/1995 | Kresse et al. | 15/228 |

FOREIGN PATENT DOCUMENTS

| | | |
|---|---|---|
| 0 017 208 | 12/1981 | European Pat. Off. . |
| 0 249 353 | 12/1987 | European Pat. Off. . |
| 0 175 019 | 3/1988 | European Pat. Off. . |
| 0 305 031 | 3/1989 | European Pat. Off. . |
| 0 390 430 | 3/1990 | European Pat. Off. . |
| 0 370 698 | 5/1990 | European Pat. Off. . |
| 26 11 615 | 9/1977 | Germany . |
| 32 46 161 | 1/1988 | Germany . |
| 39 35 649 | 2/1991 | Germany . |
| 40 22 326 | 1/1992 | Germany . |
| 1 604 448 | 9/1981 | United Kingdom . |
| 2 204 229 | 9/1988 | United Kingdom . |
| 2 206 037 | 12/1988 | United Kingdom . |
| 2 209 662 | 5/1989 | United Kingdom . |
| 2 209 663 | 5/1989 | United Kingdom . |
| 91/07129 | 5/1991 | WIPO . |
| 91/07130 | 5/1991 | WIPO . |
| 91/16849 | 11/1991 | WIPO . |

*Primary Examiner*—Randall E. Chin
*Attorney, Agent, or Firm*—Foley & Lardner

[57] ABSTRACT

A collapsible mop pad holder including a body member, at least first and second wing parts each pivotally connected to the body member so as to be pivotable between an operative position in which the body member and the wing part define a surface for supporting a mop pad, and an inoperative position in which the wing part depends from the body part, first and second locking means for locking the first and second wing parts, respectively, in relation to the body member in the operative positions of the wing parts, each of said first and second locking means comprising a first latch member moveable between a locking position, in which it is in locking engagement with the respective wing part in its operative position, and a releasing position, a locking element having the first latch members arranged thereon being moveably mounted on the body member so as to be moveable in relation thereto, and first actuating means for moving the locking element so as to move the first latch members between their locking and releasing positions. A combination of a mop pad holder and a mop pad, and the mop pad holder and a mop pad for use in such a combination is further disclosed.

53 Claims, 12 Drawing Sheets

Fig. 13
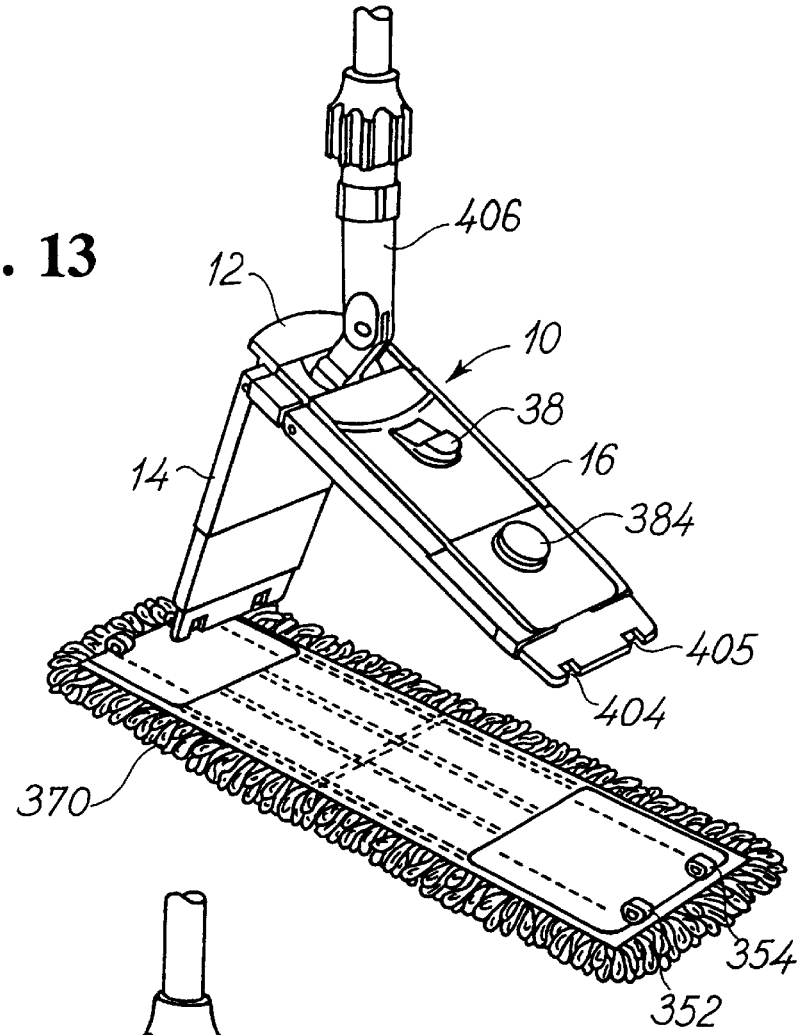
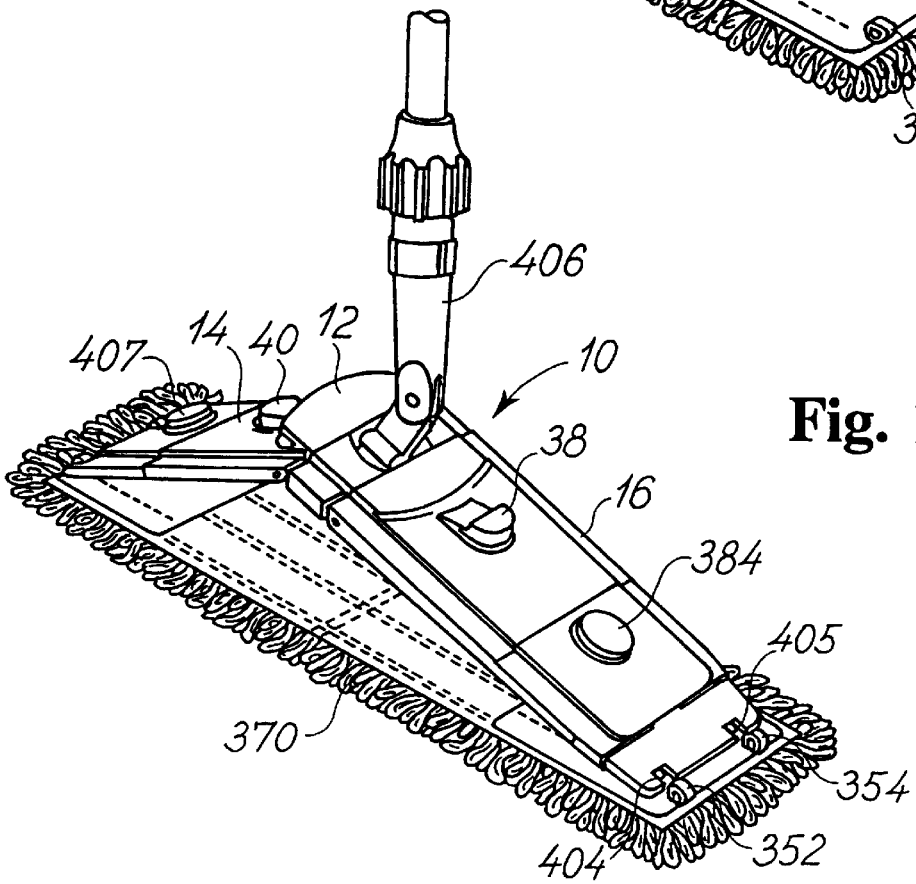
Fig. 14

COLLAPSIBLE MOP PAD HOLDER

The present invention relates to a collapsible mop pad holder which is collapsible from an operative cleaning position to inoperative positions in which the pad can be washed, pressed, attached and detached. The mop pad holder can also be operated as a conventional non-collapsible mop pad holder.

BACKGROUND OF THE INVENTION

1. Field of the Invention

It is known for such mop pad holders to comprise an intermediate section in which two opposite wing parts are pivotably attached, and latch means are operative to hold the wing parts in a substantially plane and aligned position when the holder is in its operative cleaning position. In the collapsed position, at least one of the wing parts will depend down from the intermediate section after release of locking means, and in this condition the mop can e.g. be washed and wringed in a mop wringer.

2. Description of the Prior Art

Collapsible mop pad holders of the type in question are disclosed for example in GB-A-2 206 037, EP-A2-461 684, WO 91/07129, WO 91/07130, WO 91/6849, DE-A-3 622 291 and EP-B1-175 019.

From the above and other references, it is known to provide collapsible mop pad holders which facilitate cleaning and wringing of at least part of the mop pad. The size of the part of the mop pad being wringed depends on the symmetry of the collapsed mop pad holder in the collapsed position. This symmetry depends on the way in which the mop pad holder collapses. It will be preferred that the mop pad holder collapses in a symmetrical way so that the whole of the mop pad may be inserted into e.g. a mop wringer for optimal wringing of the mop pad. This optimal wringing is facilitated in e.g. DE Published Patent Application No. 3 622 291, wherein the wing parts of the mop pad holder collapse symmetrically about two axes. However, as the collapsing of this mop pad holder is released by turning the handle of the mop pad holder, such collapsing may be accidentally released during use of the mop pad holder as this turning operation is typical in a working situation using a mop.

Furthermore, the collapsed position may be used for the attachment of the mop pad. However, a mop pad holder having both wing parts freely moving in relation to the intermediate section may be difficult to handle during attachment of the mop pad thereto. It will for this purpose be preferred that at least one of the wing parts is fixed in relation to the intermediate section to ease the attachment of the mop pad to the mop pad holder. In the prior art, this and the former problems have not both been satisfactorily solved in a single mop pad holder.

From the above and other references, it is further known to provide a separate mop pad holder and mop pad, which is fastened to the mop pad holder by means of e.g. snap fasteners, hook-and-loop fasteners (also known as Velcro®), fasteners foldable around the mop pad and snap locked, or the like. All these fasteners suffer from a severe drawback; they can for all practical use only be attached to the mop pad holder by the use of at least one hand, whereby the user will be exposed to the unhealthy cleaning fluids and dirt collected by the mop pads. A problem with the most easily operated fasteners is that these mop pads are likely to detach from the mop pad holders when collapsing the mop pad holder for cleaning and wringing the mop pad. Therefore, the use of mop pad holders prior to this invention gives unpleasant and unhealthy working situations for the user who will have to bend down each time a mop pad is to be attached or detached.

The provision of fasteners having corresponding fastening means attached to the mop pad often poses a problem when the mop pad is used or replaced as the size of the mop pad does not always fit the mop pad holder. The mop pad may be stretched after several periods of use or when used on a surface having a high friction, resulting in the mop pad not being in the appropriately stretched position relative to the mop pad holder-which gives an unsatisfactory operation of the mop. The mop pad may, on the other hand, shrink as an effect of boiling/washing the mop pad in hot water, making the mop pad difficult or impossible to attach to the mop pad holder.

DESCRIPTION OF THE PREFERRED EMBODIMENT

The present invention provides an improved mop pad holder providing a larger comfort for the user. This mop pad holder

- is adjustable so as to take into account the different lengths of mop pads,
- provides a constant stretching of the mop pad during use,
- may change position from the operational to the collapsed position by means of foot-activated activator means,
- offers a symmetric collapsing so as to provide optimum wringing of the mop pad,
- offers inoperative positions especially well suited for attaching the mop pad to the mop pad holder,
- offers an attachment where the mop pad holder is merely positioned on and pressed towards the mop pad, and
- offers detachment of the mop pads without the use of hands with the possibility of lifting the mop pad and leaving it at a specified place or in a specified container after detachment.

The mop pad holder according to the invention further offers an improved working situation in which

- the user is prevented from direct exposure to cleaning fluids and dirt on the mop pad and the mop pad holder,
- the user is spared from unpleasant working positions such as when bent down during changing mop pads or changing the positions of the mop pad holder, such as when cleaning and wringing the mop pad,
- accidental collapsing of the mop pad holder during use is prevented, and
- accidental detachment of the mop pad during e.g. wringing is prevented.

In one aspect, the present invention relates to a collapsible mop pad holder comprising a body member, at least first and second wing parts each pivotally connected to the body member so as to be pivotable between an operative position in which the body member and the wing part define a surface for supporting a mop pad, and an inoperative position in which the wing part depends from the body part, first and second locking means for locking the first and second wing parts, respectively, in relation to the body member in the operative position of the wing parts, each of said first and second locking means comprising a first latch member moveable between a locking position, in which it is in locking engagement with the respective wing part in its operative position, and a releasing position, a locking element having the first latch members arranged thereon being movably mounted on the body member so as to be movable in relation thereto, and first actuating means for moving the locking element so as to move the first latch members between their locking and releasing positions. Preferably the first latch members are moved substantially simultaneously between their locking and releasing positions.

This type of mop pad holder is the most preferred type as this mop pad holder offers optimum wringing of the mop pad, and it provides a larger comfort for the user.

The mop pad holder may further comprise a second actuating means adapted to move only one of said first latch members to its releasing position when actuated. In this way one type of intermediate position is obtained in which one of the wing parts depends from the body member while the other wing part is locked in the operative position. This intermediate position may be especially useful when attaching a mop pad to the mop pad holder. When wringing the mop pad, the first actuating means is advantageously used for releasing both the wing parts.

It may be desired that the first and second actuating means are adapted to impart different movements to the locking element when actuated. This offers a great versatility in the number and the type of positions obtainable with these actuating means. This will increase the applicability of the mop pad holder and the comfort when using the mop pad holder as will be described below.

The mop pad holder may further comprise second latch members for locking each of the first and second wing parts in an intermediate position between the operative position and the inoperative position of the respective wing part. This embodiment offers a second type of intermediate position of the wing parts in which both wing parts are rotated in relation to the body member. This intermediate position is useful when attaching mop pads to the mop pad holder. This attachment will be described in detail in connection with the drawings.

The second latch members are preferably arranged on the locking element so as to be moveable therewith, whereby each of the second latch members may be moved from a releasing position into a locking position for locking the respective wing part in its intermediate position. Furthermore, the first and a second latch members may preferably be formed integrally with the locking element.

The locking element may be mounted so as to be moveable on the body member. Thus, the locking element may be displaceably mounted on the body member, and in a presently preferred embodiment of the mop pad holder, the locking element is mounted rotatably on the body member. This offers a simple, durable and efficient way of locking and maintaining the locking position of the mop pad holder during use thereof.

In this embodiment, the latch members are preferably moved between their locking and releasing positions by rotational movement of the locking element, and the first latch members may preferably be moved between their releasing and locking positions by rotating the locking element through predetermined first and second angles, respectively.

In one embodiment of the mop pad holder, the first and second angles may be substantially the same. In an other embodiment the first angle may exceed the second angle.

It is preferred that the locking element is rotated through different angles corresponding to the first and second angles by actuating the first and second actuating means, respectively. In this way one actuating means may be actuated when the mop pad is to be wringed and the other actuating means may be actuated when a mop pad is to be attached to the mop pad holder. This will be described in further detail in connection with the drawings.

The first and second angles may be quite small compared to the prior art, such as DE Published Patent Application No. 3 622 291, wherein the rotation angle is 90°. The first and second angles in the present invention may preferably be 2°–25°, such as 3°–15°, preferably 5°–10°. The difference between the first and second angle is preferably 1°–15°, such as 2°–10°, even more preferably 3°–8°.

To ensure an easy manufacturing of the mop pad holder, it is preferred that the first and the second locking means are arranged at substantially the same distance from the axis of rotation of the locking element. In this way, identical components may be used in the wing parts.

For the same reason, it is preferred that the first latch members are arranged at substantially the same distance from the axis of rotation of the locking element.

In an especially preferred embodiment, the first and second actuating means define cam surface parts cooperating with corresponding cam surface parts defined by the locking element so as to rotate the locking element and the latch members arranged thereon towards their releasing positions when any of the first and second actuating means is actuated. Cam surface parts provide stabile and easily manufactured actuating means and locking elements.

In a preferred embodiment, a pair of first latch members are positioned substantially diametrically oppositely to the rotational axis of the locking element. This facilitates the use of identical first and second locking means as the interface between the locking means and the locking element is identical for each of the wing parts.

It may be advantageous that a pair of second latch members are positioned substantially diametrically oppositely to the rotational axis of the locking element.

In an other preferred embodiment, the locking element is spring-biased towards the locking position of the latch members. Biasing by spring elements offers a stable, efficient and cheap biasing. Spring elements may be moved between a more compressed state and a less compressed state a large number of times without breaking or loosing the biasing strength. Furthermore, spring elements are easily mounted during manufacturing of the mop pad holder.

To conclude, the mop pad holder according to the invention may comprise elements which are easily produced. Part of the elements in the wing parts and the locking means of the mop pad holder may be identical. The elements may be made of plastics, such as poly-propylene, and similar materials. These elements may be produced by injection moulding or similar methods which, together with the fact that a number of the elements are identical, encourage serial production and cheap manufacturing of the mop pad holder.

According to another aspect, the invention relates to a combination comprising a collapsible mop pad holder having a body member and at least one wing part pivotally connected to the body member so as to be pivotable between an operative position in which the body member and the wing part define a surface for supporting a mop pad, and an inoperative position in which the wing part depends from the body part, and a mop pad mounted on the mop pad holder and being supported by said supporting surface, each of opposite end portions of the mop pad being fastened to the mop pad holder by fastening means, which define a pivot axis extending transversely to a longitudinal axis of the mop pad, whereby the mop pad may rotate about said pivot axis in relation to the mop pad holder when the wing part is moved between its operative and inoperative positions.

In a preferred embodiment of the combination each fastening means may comprise bore-defining means and complementary stud members for engagingly cooperating therewith, the bore-defining means and the stud members being fixed to adjacent end portions of the mop pad and of the mop pad holder, or vice versa, and the bore-defining means and stud members fixed to the mop pad holder being adapted to be brought into and out of locking engagement.

By using stud members and bore-defining means, it is ensured that the mop pad is secured to the mop pad holder during use. This way of attaching the mop pad to the mop pad holder offers attaching the mop pad along substantially the whole width of the mop pad. This prevents the mop pad from folding during use on a high-friction surface. This enables a strong and stable attachment during e.g. use on high-friction surfaces and during wringing of the mop pad.

The use of bore-defining means and stud members offers a simple attachment of the mop pad to the mop pad holder. In one embodiment, the bore-defining means and the stud members fixed on the mop pad holder may be axially displaceable. This facilitates engagement of corresponding bore-defining means and stud members in a way so that displaceable bore-defining means and stud members are not necessary on the mop pads. This will be described in detail in connection with FIGS. 3–6.

To obtain an advantageous attachment of the mop pad to the mop pad holder it is preferred that the stud members and the bore-defining means are axially spaced.

In a preferred embodiment, the stud members and the bore-defining means fixed on the mop pad holder may be rotatably displaceable. This will be described in detail in connection with FIGS. 7 and 8.

In one embodiment, the bore-defining means may be an integral part of the mop pad, and the stud members may be an integral part of the mop pad holder. In an other embodiment, the bore-defining means may be an integral part of the mop pad holder, and the stud members may be an integral part of the mop pad.

To simplify attachment of the mop pad to the mop pad holder, motion means are preferably provided for moving the bore-defining means and the stud members into and out of engagement. In this way the movement of the engagement of a number of bore-defining means and a number of stud members is controlled by a single motion means.

During wringing and other use of the mop pad holder accidental detachment of the mop pad may occur. To prevent this, the motion means preferably comprise blocking means for blocking the movement of the motion means. The blocking means are adapted to allow detachment of the mop pad in certain situations and not in certain other situations where detachment is not desired. This will be described in further detail below.

Due to the above mentioned problems with the varying lengths of the mop pads, it is preferred that the mop body comprises outer casings and inner casings displaceable in relation to each other in a telescopic manner so that the length of the mop pad holder may be adjusted. In this way, the varying length of the mop pads does not interfere with the use thereof as each fastening means of the mop pad holder is able to stretch mop pads having length variations of 3–100 mm, such as 5–50 mm, preferably 10–30 mm, such as 20–25 mm, more preferably in the order of 22 mm. In practice, this means that the mop pad holder is able to stretch mop pads having twice this length variation as a mop pad is typically stretched between two fastening means. The width of the mop pad is preferably 2–40 cm., such as 5–25 cm., preferably 7–17 cm., such as in the order of 11 cm. The length of the mop pad is preferably 5–150 cm., such as 10–105 cm., preferably 20–70 cm., such as 30–50 cm., even more preferably in the order of 47 cm.

Another advantage of this is that if the mop pad holder, when used for mopping a surface, hits a wall, door, door casing, etc., this spring-biasing of the mop pad holder will minimize scratches and other damage.

To further ensure the attachment of a mop pad it is preferred that the motion means comprises a spring-biased motion element activated by actuating means thereby allowing the motion element to be displaced into a fastening position. This spring biasing will ensure that the motion element does not accidentally detach the mop pad during use.

In a preferred embodiment, the bore-defining means are projecting eyelets.

It is preferred that the mop pad holder used in this combination is the mop pad holder described in connection with the first aspect of the invention.

The invention further relates to a mop pad which may advantageously be used in the combination with the mop pad holder according to the invention. The mop pad comprises at each end portion thereof first pivot axis defining means for engagingly cooperating with second pivot axis defining means arranged on the mop pad holder, the first and second pivot axis defining means being adapted to cooperate so as to define in combination a pivot axis extending transversely to the longitudinal axis of the mop pad and allowing mutual pivotal movement of the mop pad holder and the mop pad when the latter is mounted on the mop pad holder.

It is preferred that the first pivot axis defining means comprise bore defining means and/or stud members arranged on the mop pad holder. As described above, this offers an efficient and easy attachment of the mop pad to the mop pad holder.

The bore-defining means is preferably in the form of eyelets projecting from the pad, and preferably the bore-defining means define an abutment surface for engaging with the fastening means so as to release the fastening means and allow them to be moved to their fastening position. Preferably, the end portions of the mop pad are shaped so as to engage with the pivot axis defining means of the mop pad with a light pressure fit.

It is further preferred that at least the end portions of the mop pad comprising the first pivot axis defining means are made relatively stiff in one manner or another. In a preferred embodiment a relatively stiff plate member is attached to each end portion of the mop pad.

To facilitate attachment and detachment of the mop pad from the mop pad holder, the pivot axis defining means, such as the bore defining means and/or the stud members are preferably formed integrally with a plate member attached to an end portion of the mop pad. The plate member may for example be made of plastics or nylon 6—6.

For easy attachment of the plate member to the end portions of the mop pad, portions of the plate member are preferably weakened by either consisting of a thinner layer of material or by perforating the relevant portions. This facilitates sewing the plate member to the end portions of the mop pad without the use of special equipment. The plate member may optionally be glued or welded to the end portions of the mop pad or attached thereto by interengaging releasable fastening means, such as VELCRO®.

BRIEF DESCRIPTION OF THE DRAWINGS

The invention will now be further described with reference to the drawings, in which FIGS. 13 and 14 illustrate the attachment of the mop pad to the mop pad holder when the mop pad holder is in its intermediate position shown in FIG. 10.

DESCRIPTION OF THE PREFERRED EMBODIMENTS

Figure 1:
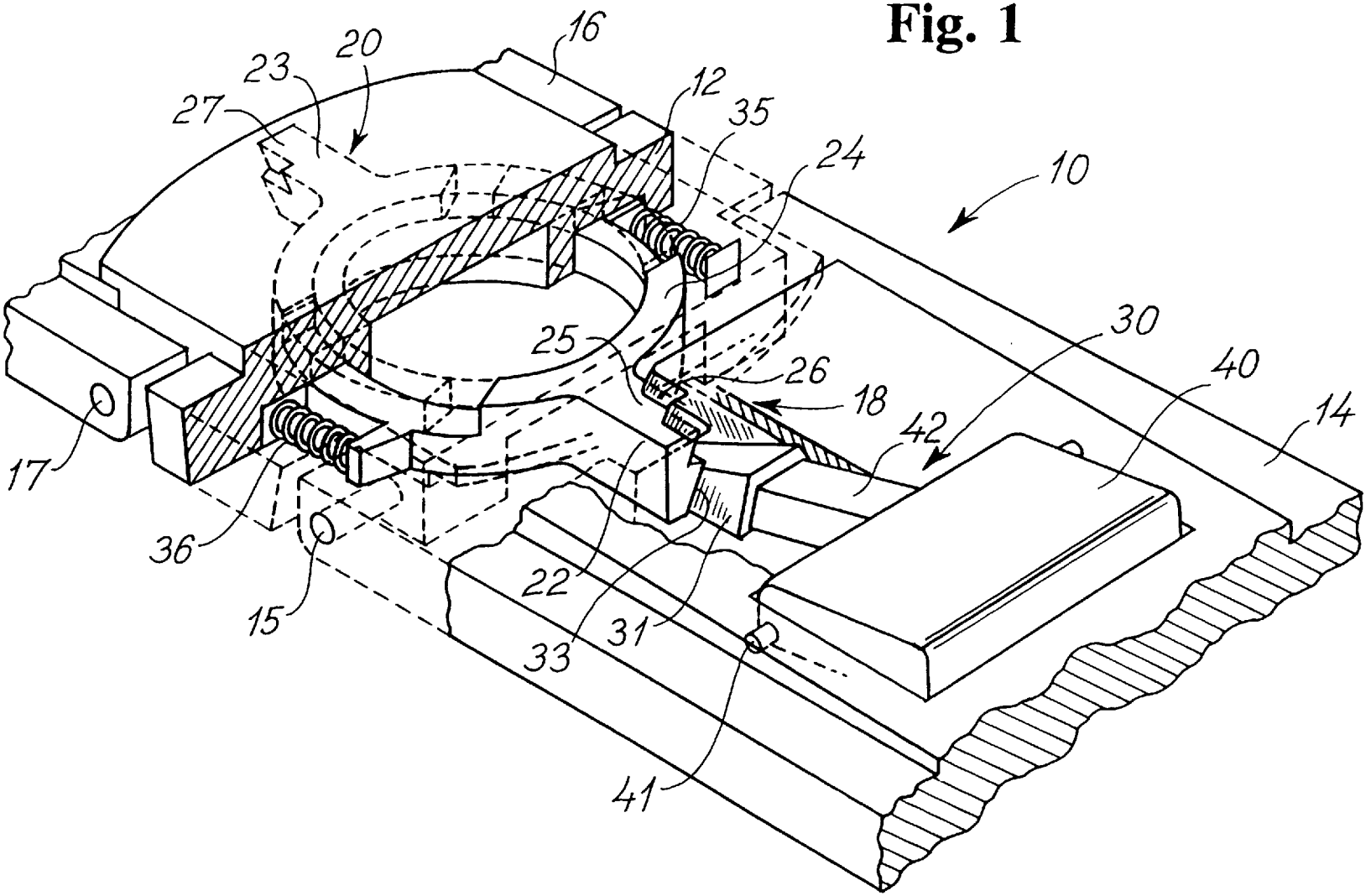
FIG. 1 is a perspective and sectional view of an embodiment of the mop pad holder according to the present invention in an operative position.

FIG. 1 shows one embodiment of a mop pad holder 10 according to the present invention in its operative position. The mop pad holder 10 comprises a body member 12, a first wing part 14 and a second wing part 16. The wing parts 14 and 16 are pivotably attached to the body member 12 by means of axles 15 and axles 17, respectively, extending through both the body member 12 and the wing parts 14 and 16, respectively. The mop pad holder 10 is further provided with first and second locking means 18 and 20 for locking the first wing part 14 and the second wing part 16, respectively, in relation to the body member 12 in the operative position. The locking means 18 and 20 comprise first latch members 22 and 23, respectively, arranged on a locking element 24. The first latch member 22 is provided with a surface part 25 which is in engagement with a corresponding surface part 26 of the first wing part 14 so that the wing part 14 and the body member 12 are locked in the operative position. Similarly, the latch member 23 is provided with a surface part 27 which engages a corresponding surface part (not shown) of the second wing part 16, and thereby locks the wing part 16 in relation to the body member 12 in the operative position. Thus, in the operative position the two wing parts 14 and 16 and the body member 12 define a substantially plane lower side surface for supporting a mop pad. The mop pad holder 10 is further provided with spring elements 35 and 36 for spring-biasing the locking element 24 so as to assure engagement of the surface part 25 of the latch member 22 and the corresponding surface part 26 of the wing part 14 and similarly in connection with the wing part 16. In this way, the first and second locking means 18 and 20, shown in FIG. 1, lock the mop pad holder 10 in the operative position.

The locking element 24 is rotatably mounted on the body member 12. When rotating the locking element 24 so as to press the spring elements 35 and 36 together, the latch members 22 and 23 arranged thereon will rotate so that the surface part 25 of the latch member 22 will be moved out of the engagement with the surface part 26 of the first wing part 14 and similarly in connection with the second wing part 16, whereby the wing parts 14 and 16 may be pivoted in relation to the body member 12. In this way, the mop pad holder 10 may be brought from the operative locked position to a released position in which the wing parts 14 and 16 are pivotable in relation to the body member 12.

The locking element 24 is preferably rotated by depressing actuating means 30 (an actuating means is preferably applied for each latch member 22 and 23, however, only one actuating means 30 is shown in the drawings). The actuating means 30 comprises a pedal 40, which is rotatably mounted on the wing part 14 by means of a rod 41, and an engaging element 42 with a cam surface part 31. When the pedal 40 is depressed, the cam surface part 31 of the engaging element 42 engages with a corresponding cam surface part 33 of the latch member 22 so as to rotate the locking element 24 and the latch members 22 and 23 relative to the wing parts 14 and 16. As described above, this facilitates a disengagement of the surface part 25 of the latch member 22 and the surface part 26 of the first wing part 14 and similarly for the second wing part 16, and thereby a release of the wing parts 14 and 16 relative to the body member 12.

In this embodiment, the movements of the latch members 22 and 25 locking the two wing parts 14 and 16 in the different positions are preferably identical so that the movement of the wing parts 14 and 16 is identical. The wing parts 14 and 16 will therefore preferably be brought from the same positions to the same positions at substantially the same time.

Figure 2:
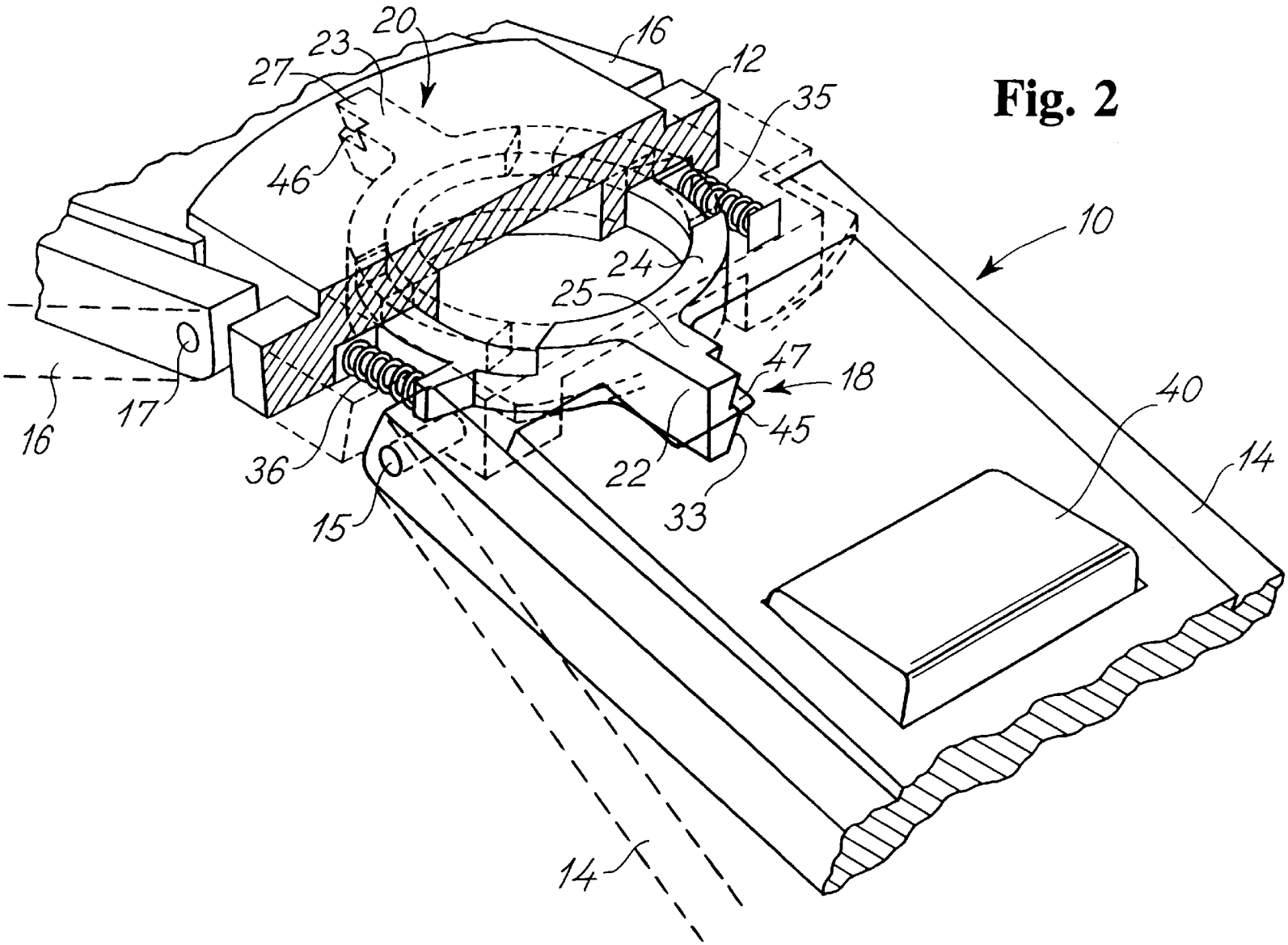
FIG. 2 is the same as in FIG. 1 shown in an intermediate position between the operative position and a collapsed position.

FIG. 2 shows the body member 12 and part of the wing parts 14 and 16 of the mop pad holder 10 disclosed in FIG. 1. In this figure, the wing parts 14 and 16 are locked in an intermediate position between the operative position and a collapsed position. The locking means 18 and 20 having the first latch members 22 and 23, respectively, arranged on the locking element 24, are further provided with second latch members arranged thereon. In the embodiment shown in FIG. 2, the first and second latch members are integrated in the latch members 22 and 23. The first latch members 22 and 23 are provided with further surface parts 45 and 46, respectively, constituting at least part of the second latch members. The surface part 45 engages a corresponding surface part 47 of the first wing part 14. The engagement of the surface part 46 with the corresponding surface part of the second wing part 16 is not shown in the drawing.

For the mop pad holder 10 to come into the intermediate position shown in FIG. 2, the locking element 24 has been rotated from the operative position shown in FIG. 1. This rotation may be performed by pressing the pedal 40 shown in FIG. 1. When the locking element 24 has been rotated a certain angle, the surface part 26 of the wing part 14 disengages the surface part 25 of the latch member 22 whereby the first wing part 14 may be rotated downward until the surface parts 45 and 47 engage. If the locking element 24 is rotated further, also the surface parts 45 and 47 will disengage and the first wing part 14 will rotate freely about the axle 15.

The first wing part 14 may thereafter be brought to either of the positions shown in FIGS. 1 or 2 by simply rotating the first wing part 14 about the axle 15 to the desired position. The spring elements 35 and 36 will allow the locking element to rotate when the surface part 26 engages the cam surface part 33. Thereafter, the surface part 45 will again engage the surface part 47 and the first wing part 14 will be in the intermediate position. If the first wing part 14 is rotated further, the surface part 26 will again engage the surface part 25. Of course the same will be possible for the second wing part 16.

In an other embodiment of the mop pad holder 10 according to the invention, an intermediate position may be facilitated in which one of the wing parts depends from the body member 12 while the other wing part is locked in relation to the body member 12 in the operational position. This asymmetric unlocking of the wing parts may be facilitated by having asymmetric locking means 18 and 20. One way of accomplishing this will be not to have the latch members 22 and 23 positioned directly opposite each other on the locking element 24. If the interacting surface parts 25 and 26 of the latch member 22 and the wing part 14, respectively, are otherwise identical to the corresponding surface parts in connection with the wing part 16, the engagement of the surface parts in one locking means will stop before the engagement of the surface parts of the other locking means when rotating the locking element.

This asymmetry may also be accomplished by having the latch members 22 and 23 positioned substantially directly opposite each other on the locking element 24 and having asymmetric surface parts on the wing parts for engaging the surface parts of the latch members 22 and 23.

This asymmetry will define a relatively smaller angle through which the locking element is to be rotated before the first locking means is released, and a relatively larger angle through which the locking element is to be rotated before both locking means are released.

To rotate the locking element through these two angles, a wide variety of actuating means may be used. In a preferred embodiment two actuating means are used, one for each of the angles. In general, the actuating means may be similarly made or not.

If the actuating means are similarly made, the difference in the angles through which the locking element is rotated by the two actuating means may be defined by either actuating the two actuating means differently, such as depressing these to different depths, or one of the actuating means may have a clearance before the cam surface parts engage and the locking element is rotated. This reduces the effective depth that the actuating means is depressed.

When the actuating means are not made similarly the actuating means may be of the type used in the previous embodiment in which cam surface parts engage to rotate the locking element. These cam surface parts may have different angles with respect to a vertical axis so that two actuating means when depressed the same depth may rotate the locking element differently. Also the distance from the cam surface part of the latch member engaging the cam surface part of the actuating means may be altered to alter the rotation angle of the locking element. Identical movements of the latch members at different distances from the axis of rotation of the locking element will give different rotation angles of the locking element.

Figure 9:
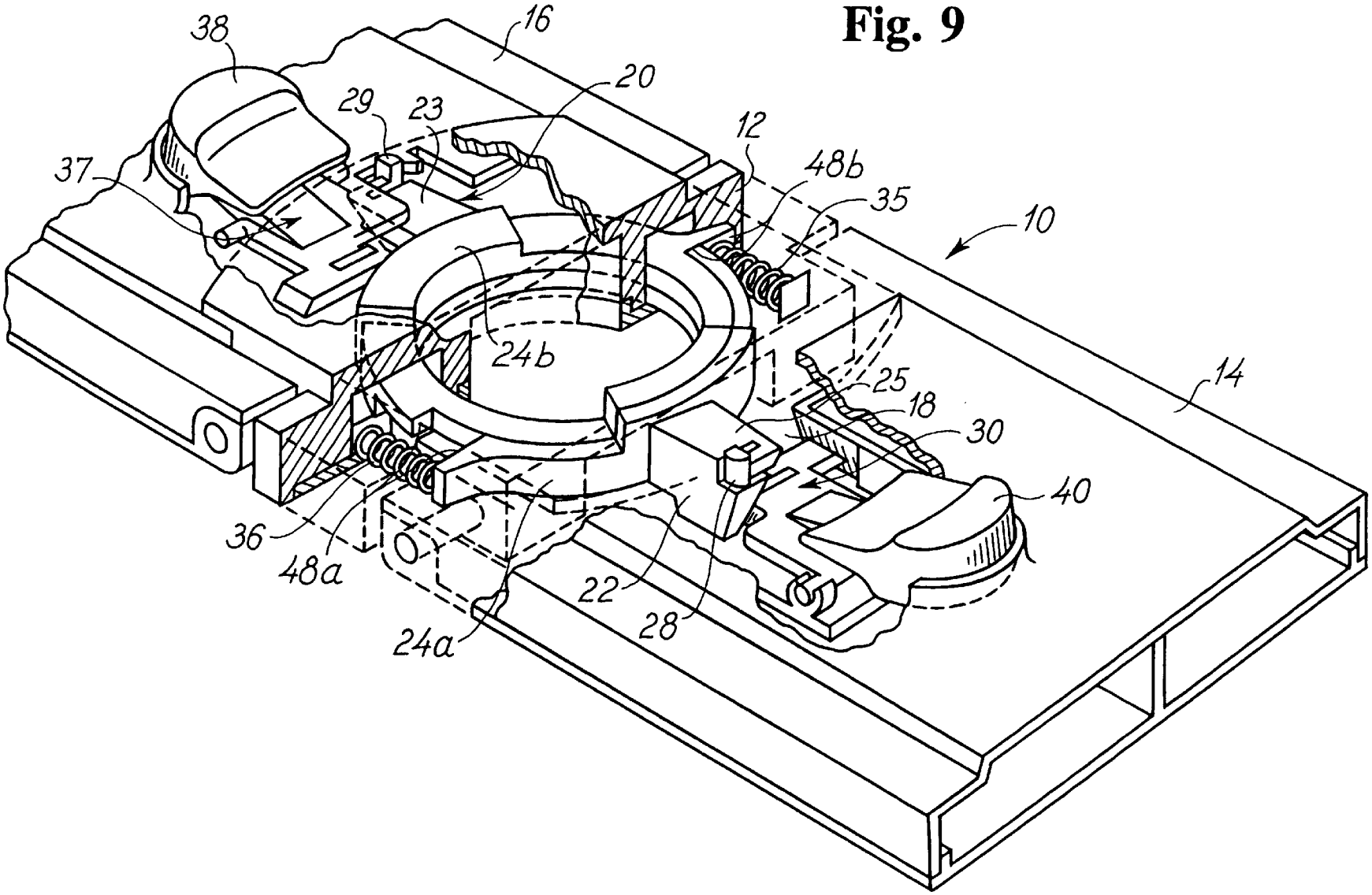
FIG. 9 is a perspective and sectional view of a further embodiment of the mop pad holder according to the present invention in its operative position.
Figure 10:
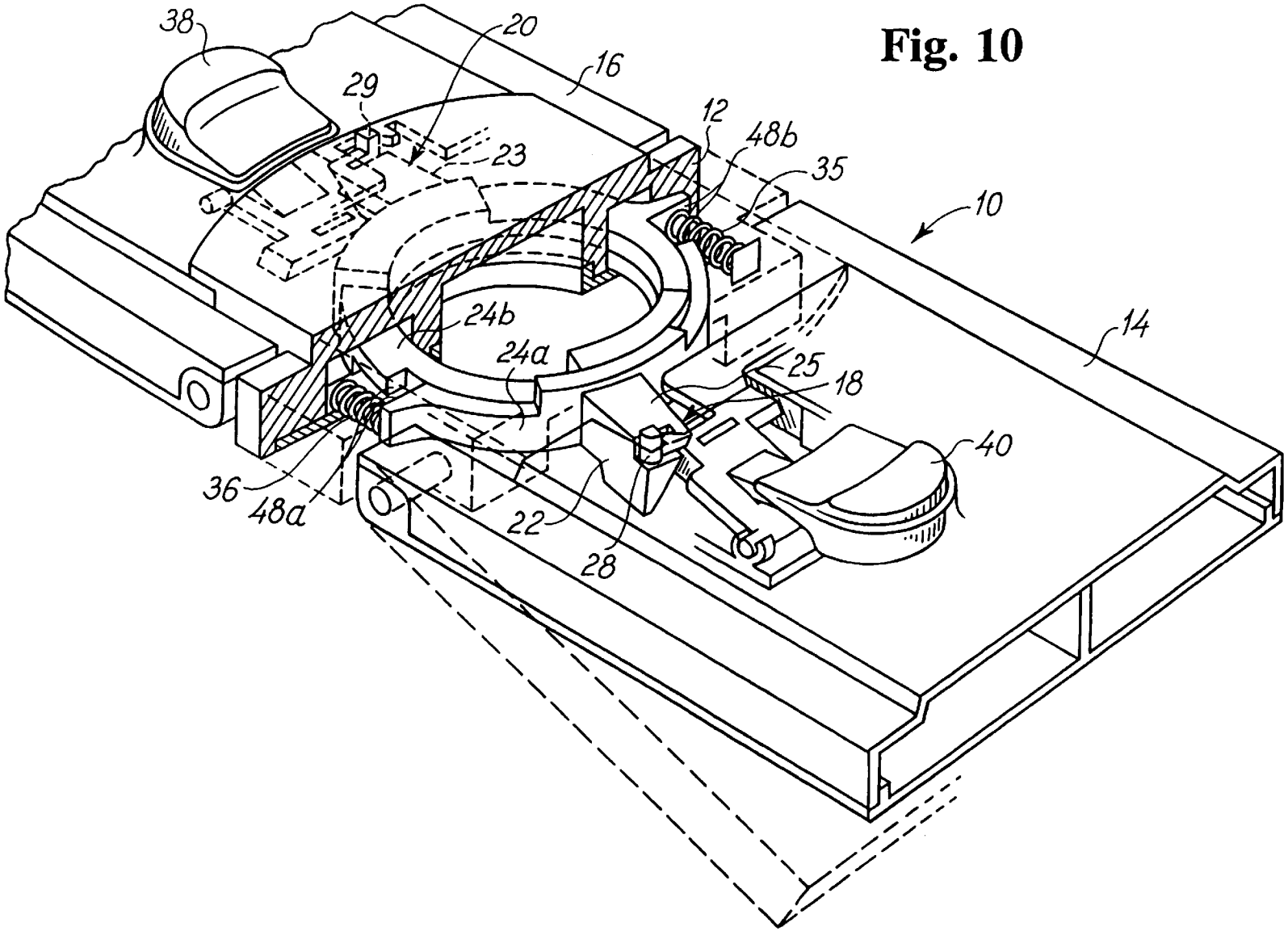
FIG. 10 is a perspective and sectional view of the embodiment shown in FIG. 9 in an intermediate position between the operative position and a collapsed position.

FIG. 9 shows a further embodiment of a mop pad holder 10 in its operative position. In this embodiment selective unlocking of the respective wing parts 14 and 16 is rendered possible. The annular locking element 24 is divided into a pair of annular locking elements 24*a* and 24*b* which are rotatably mounted in relation to each other about the central axis of the locking element 24. The relative rotational movement of the locking member parts 24*a* and 24*b* is restricted to a predetermined angle defined by pairs of cooperating abutment surfaces 48*a* and 48*b*. The latch members 22 and 23 which are projecting outwardly from the locking element parts 24*a* and 24*b*, respectively, are positioned in relation to the abutment surfaces 48*a* and 48*b* in such a manner that depression of the pedal or button 40 results in rotation of the locking element part 24*a*, only. This means, that depression of the pedal 40 results in movement of the latch member 22, whereby the wing part 14 is allowed to fall down so as to depend from the body member 12 while the other wing part 16 remains locked in its operative position. This is illustrated in FIG. 10 where the pedal 40 has been depressed whereby the wing part 14 is released. As explained more in detail with reference to FIG. 13 such position with one depending wing part is used in connection with mounting of the mop pad one the mop pad holder.

When the pedal or button 38 is depressed the upper locking element part 24*b* is rotated in a clockwise direction in FIG. 9. Because the abutment surface 48*b* is in engagement the rotative movement of the locking element part 24*b* is also transmitted to the locking element part 24*a*. As a result, both of the locking means 18 and 20 are released so as to allow both wing parts 14 and 16 to move into positions in which they are depending from the body member 12. In this position in which both wing parts are depending from the body member 12 of the mop pad holder 10 the mop pad will depend from the lower ends of the wing parts so that the mop pad may be wringed.

The latch members 22 and 23 may have stud members 28 and 29, respectively, extending upwardly therefrom. These stud members are adapted to cooperate with complementary cut outs or notches in the adjacent wing parts so as to clearly define the locking and/or releasing positions of the latch members.

Figure 3:
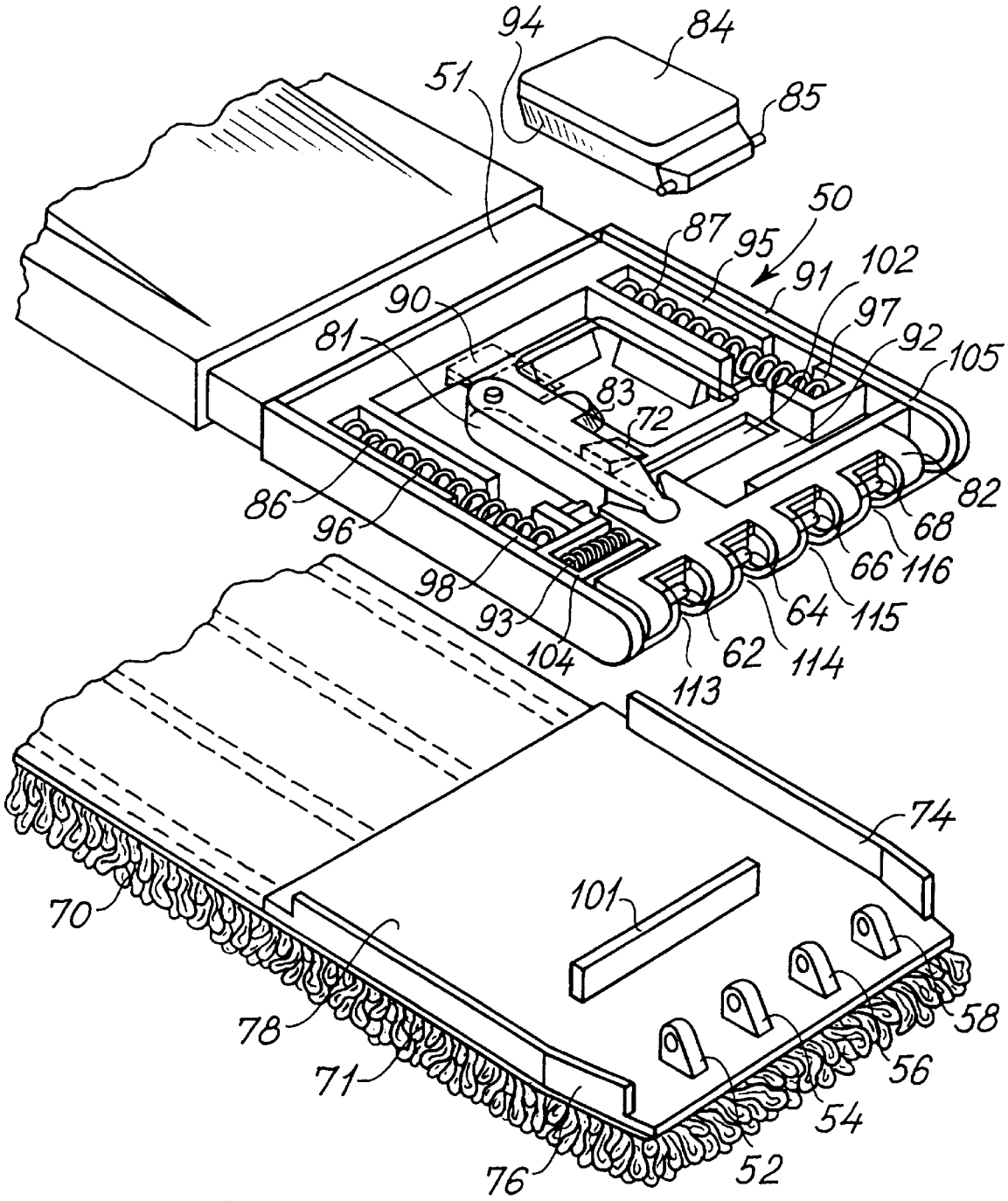
FIG. 3 is an exploded perspective view of part of the mop pad holder showing an embodiment of the fastening means for interconnecting the mop pad and the wing part in the open position of the fastening means.

FIG. 3 shows a perspective view of a first embodiment of the fastening means according to the invention. The figure shows only an end part 51 of one wing part of the mop pad holder 10. Fastening parts 50 are positioned at the opposite ends 51 of the wing parts (14 and 16 in FIGS. 1 and 2) of the mop pad holder 10 to attach opposite ends 71 of a mop pad 70 to the corresponding opposite ends 51 of the mop pad holder 10. The fastening part 50 is adapted to attach a fastening plate 78 having axially spaced eyelets 52, 54, 56, and 58 and which is attached to the mop pad 70. The fastening part 50 has axially spaced stud members 62, 64, 66, and 68 for engagingly cooperating with the complementary eyelets 52, 54, 56 and 58. In this embodiment, four eyelets are shown. Of course a variable number of eyelets may be used in this embodiment such as 1–20, preferably 2–10, such as 3–7, more preferably in the order of 4. The fastening plate 78 preferably has perforated areas (not shown) through which the fastening plate 78 is sewed together with the mop pad 70. However, the fastening plate 78 could also be attached to the mop pad by means of adhesives, snap locks, etc.

The fastening part 50 comprises an outer casing 91 and a complementary inner casing 92 extending telescopically inside the outer casing 91 and snap locked together, by means of a snap lock 90, in such a manner that displacement of the inner casing 92 relative to the wing part and substantially along a direction away from the other wing part is permitted. The length of this displacement may be 3–100 mm, such as 5–50 mm, preferably 10–30 mm, such as 20–25 mm, more preferably in the order of 22 mm. The inner casing 92 is preferably an integral part of the end part 51.

Both the inner casing 92 and the outer casing 91 define spring-guiding members 95, 96 and 97, 98, respectively, wherein spring elements 86 and 87 are positioned. The spring elements 86 and 87 provide a spring-biased connection between the outer casing 91 and the inner casing 92. This connection is biased so as to press the inner casing 92 out of the outer casing 91. This connection makes it possible to adjust the total length of the mop pad holder 10 so that this length always fits the length of the mop pad 70.

Inside the outer casing 91, motion means 80 are positioned for moving the stud members 62, 64, 66, and 68 into or out of locking engagement with the eyelets 52, 54, 56, and 58. The stud members 62, 64, 66, and 68 are preferably an integral part of a motion element 82, the motion element 82 being rotatably connected to an arm 81 by means of a node 88. The arm 81 is rotatably mounted inside the outer casing 91. A compressed spring element 93 is placed between the motion element 82 and a side wall 104 of the outer casing 91 so as to press the motion element 82 towards a side wall 105 opposite to the side wall 104.

In an open position of the fastening means shown in FIG. 3, the arm 81 is pressed, by means of the spring element 93, against an abutting projection 72 defined inside the outer casing 91. The motion element 82 and the stud members 62, 64, 66, and 68 are positioned so that, in this open position, the eyelets 52, 54, 56, and 58 are able to enter the positions in indentations 113, 114, 115, 116 in which they may engage the stud members 62, 64, 66 and 68 in the closed position.

When fastening a mop pad 70 to the mop pad holder 10, the end part 51 of the mop pad holder 10 is placed upon the fastening plate 78, guided by guiding members 74 and 76, so that the eyelets 52, 54, 56 and 58 fit into the indentations 113, 114, 115, 116. Then, the end part 51 is pressed downward so that an abutting projection 101 arranged on the fastening plate 78 enters a slot 102 in the outer casing 91. The abutting projection 101 will, when moved into the slot 102, lift the arm 81 over the blocking abutting projection 72 whereby, due to the compressed spring element 93, the motion element 82 will be moved towards the side wall 105 of the outer casing 91, and consequently the stud members 62, 64, 66 and 68 move into the eyelets 52, 54, 56 and 58, thereby fastening the mop pad 70 to the mop pad holder 10 (see FIG. 4).

Figure 4:
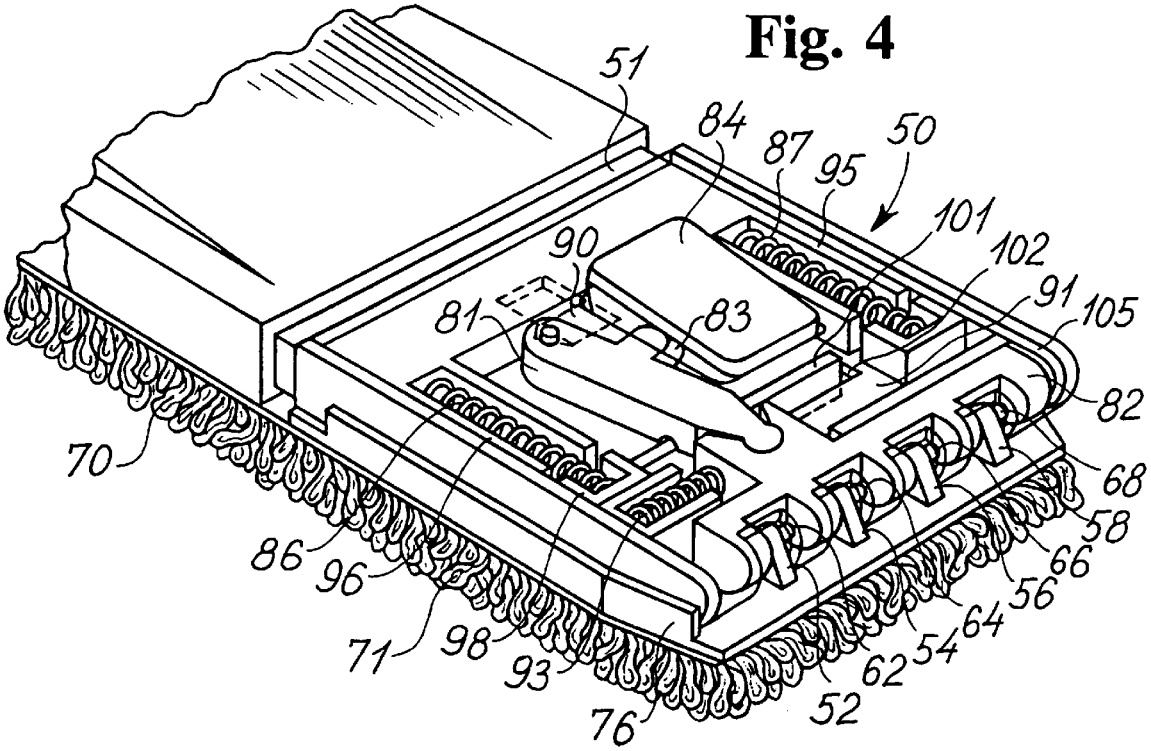
FIG. 4 illustrates the fastening means shown in FIG. 3 inter-connecting the mop pad holder and the mop pad in the fastening position of the fastening means.

In FIG. 4, the fastening means shown in FIG. 3 is shown in the closed position. It is seen that the eyelets 52, 54, 56 and 58 engage the stud members 62, 64, 66 and 68 so that the mop pad 71 is attached to the mop pad holder 10. The attachment is assured by the spring element 93. It is further seen that the projection 101 has entered the slot 102 and that the arm 81 and the motion element 82 have been moved into the closing position by the spring element 93.

For detaching the mop pad 70 and the mop pad holder 10, the fastening part 50 has a return pedal 84 being rotatably mounted in the outer casing 91 by means of rods 85. This return pedal 84 has a cam surface part 94 which, when the return pedal 84 is depressed, will engage a cam surface part 83 on the arm 81, and consequently move the arm 81 over the abutting projection 72, again moving the motion element 82 so that the stud elements 62, 64, 66 and 68 disengage the eyelets 52, 54, 56 and 58, as shown in FIG. 3, so as to open the fastening means.

The fastening means of this first embodiment, however, may be activated accidentally when wringing the mop pad 70. If the return pedal 84 is pressed, the mop pad 70 will be detached.

Figure 6:
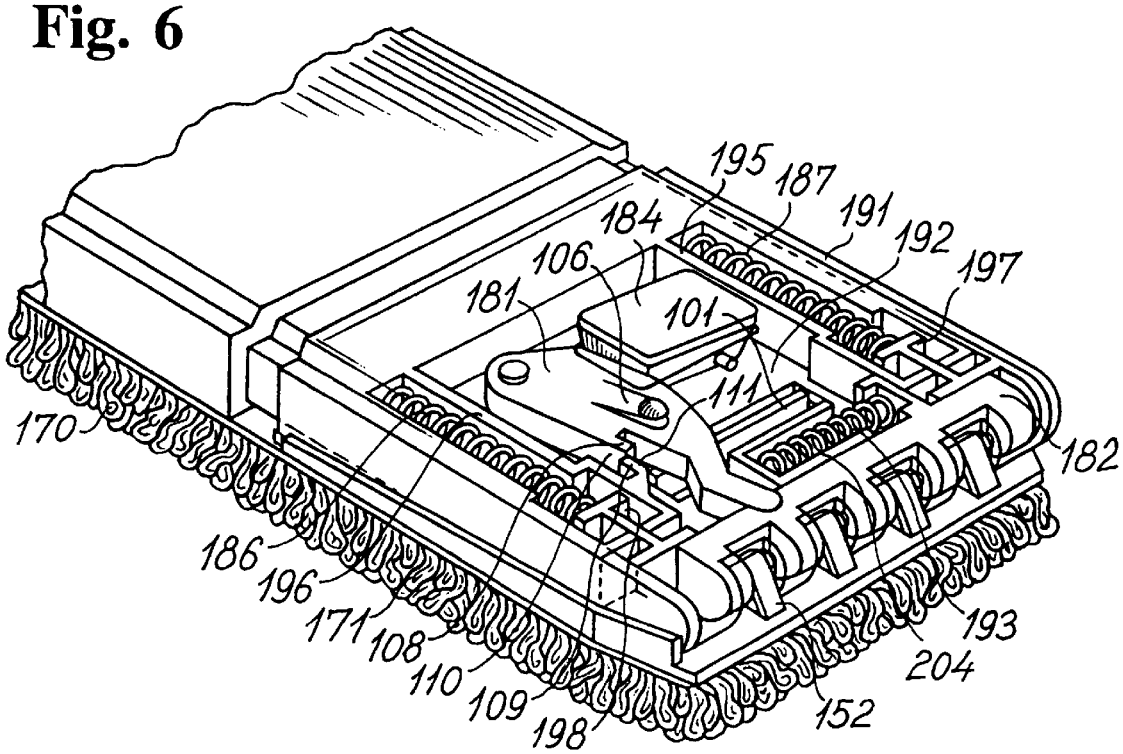
FIG. 6 is a sectional perspective view showing the fastening means illustrated in FIG. 5 interconnecting the mop pad holder and the mop pad in their fastening position.
Figure 5:
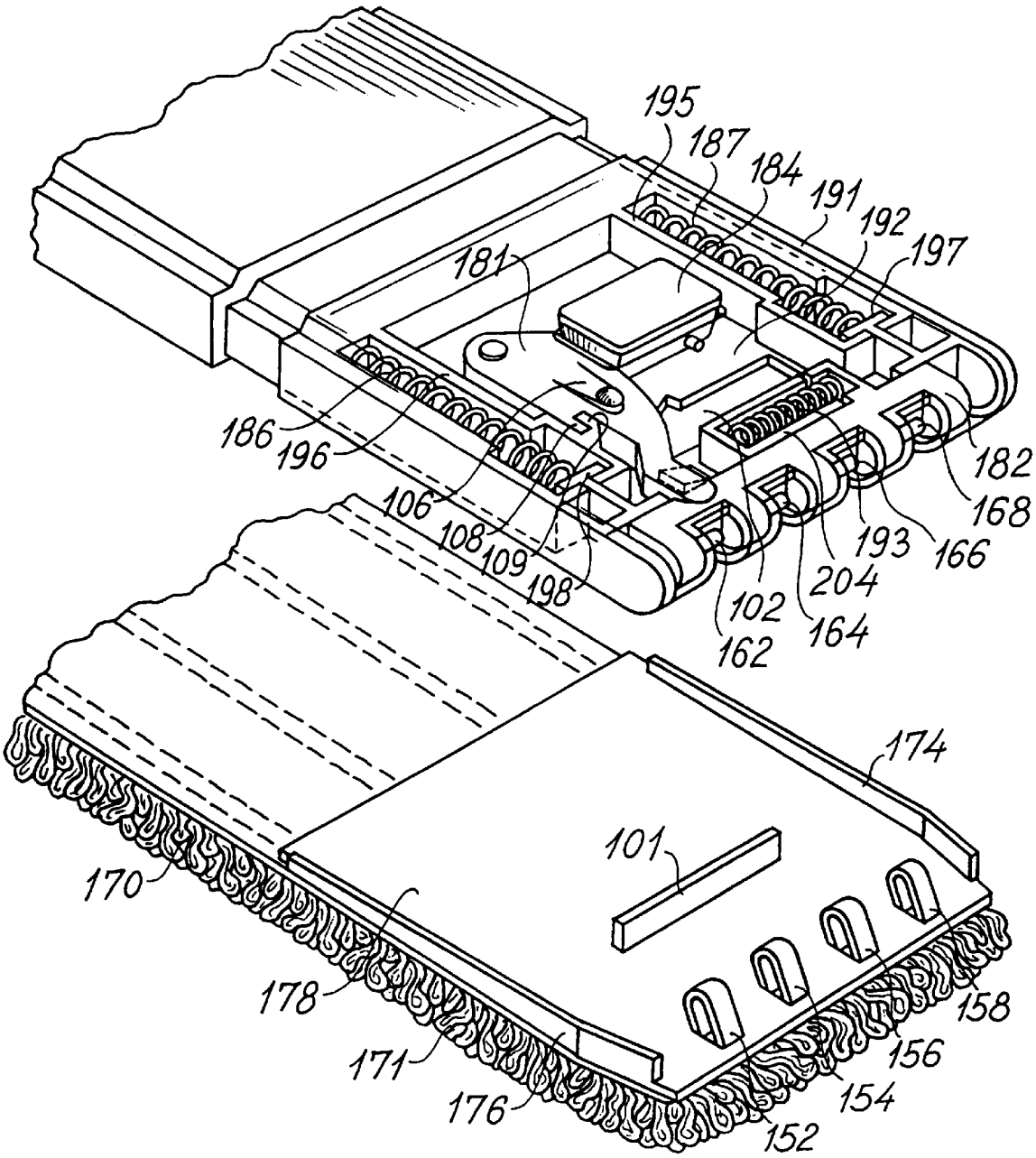
FIG. 5 is an exploded perspective view of part of the mop pad holder illustrating another embodiment of the fastening means provided with blocking means for blocking the release of the mop pad from the mop pad holder in its inoperative position.

A second embodiment of the fastening means according to the invention is shown in FIG. 5 and FIG. 6. In this embodiment blocking means are provided for blocking accidental detach of the mop pad 170 and the mop pad holder 10 when the mop pad holder 10 is in its inoperative position. FIG. 5 is an exploded and a sectional perspective view of the fastening means in the open position and FIG. 6 is a sectional perspective view of the fastening means in the closed position. This embodiment is closely related to the first embodiment shown in FIGS. 3 and 4.

The fastening means shown in FIGS. 5 and 6 operates in much the same manner as the fastening means shown in FIGS. 3 and 4. Therefore, the numerals of elements with equal functions have been added the number 100 in FIGS. 5 and 6 in relation to FIGS. 3 and 4. Equal elements, such as the projection 101, have the same numerals.

As an example of elements with equal functions, different embodiments of the spring-guiding members 195, 196, 197 and 198 (labelled 95, 96, 97 and 98 in FIG. 3), wherein the spring elements 186 and 187 are placed, are shown in FIGS. 5 and 6. The spring-guiding members serve the same purpose as those of FIGS. 3 and 4. A different embodiment will also be seen for the spring-guiding member 204 (labelled 104 in FIGS. 3 and 4) in which the spring element 193 is placed. Again, this spring-guiding member 204 serves the same purpose as the one shown in FIGS. 3 and 4.

The blocking means comprise hook parts 108 and 109 defined on the arm 181 and the inner casing 192, respectively. Again, as mentioned above, the arm 181 is rotatably mounted within the outer casing 191.

In the open position, (see FIG. 5), the hook part 108 of the arm 181 and the hook part 109 of the inner casing 192 engage and thereby fix the arm 181.

When attaching the mop pad 170 to the mop pad holder 10, the mop pad is positioned as described earlier and pressed towards the fastening part 50 simultaneously with pressing the inner casing 192 partly into the outer casing 191. In this way, the hook parts 108 and 109 will disengage whereby the arm 181 will be able to move, and, due to the spring element 193, the motion element 182 will be displaced fastening the mop pad 170 as described in connection with FIGS. 3 and 4.

As long as the mop pad holder 10 is in its operative position in which the mop pad 170 is stretched over the plane lower surface of the mop pad holder 10, the inner casing 192 is pressed partly into the outer casing 191, due to the mop pad 170 being stretched between the ends 51 of the wing parts, whereby the hook parts 108 and 109 do not engage (see FIG. 6.) and will thereby not interfere in detaching the mop pad 170 and the mop pad holder 10. The motion element 182 can therefore be moved to detach the mop pad 170 by pressing the return pedal 184 as described in connection with FIGS. 3 and 4.

When a mop pad 170 is attached to the mop pad holder 10 and the mop pad holder 10 is in a collapsed or an intermediate position, the inner casing 192 will not be pressed partly into the outer casing 191, whereby outer surface parts 110 and 111 of the hook parts 108 and 109, respectively, will be abutting. This may be imagined when looking at FIG. 6 where the fastening means is in the closed position. If the inner casing 192 was not pressed partly into the outer casing 191 the arm 181 would be translated further toward the end of the wing part so that the hook parts 108 and 109 will abut on the outer surface parts 110 and 111.

Accidentally pressing the return pedal 184 will not detach the mop pad 170 as the movement of the arm 181 is blocked by this abutment of the outer surface parts 110 and 111. This detachment of the mop pad 170 can only be accomplished by pressing the inner casing 192 partly into the outer casing 191 whereby this abutment of the outer surface parts 110 and 111 is removed and the arm 181 and the motion element 182 may be moved so as to detach the mop pad 170.

The open position of the fastening part 50 is further secured by applying a spring element 106, preferably a laminated spring, on the upper surface of the arm 181. This laminated spring 106 assures that the arm 181 abuts against the abutting projection 72 (see FIG. 3), and that this abutment is only released due to the projection 101 being inserted into the slot 102.

In FIGS. 3 and 5 different eyelets 52 and 152 are shown. Again these eyelets are shown in different embodiments, however, these eyelets have the same function. The mop pad holder 10 described above may be operated as follows:

Before attaching a mop pad 170 to the mop pad holder 10, the mop pad holder 10 is typically in the inoperative position in which position the wing parts 14 and 16 depend from the body member 12. To provide an easy attachment of the mop pad 170 to the mop pad holder 10, the mop pad holder 10 is preferably brought into the intermediate position which is especially well suited for this attachment. After this, the end parts 51 may be positioned on the mop pad 170, as described earlier, and the mop pad holder 10 may be pressed toward the mop pad 170 to attach the mop pad 170 to the mop pad holder 10.

To bring the mop pad holder 10 into the intermediate position, it is first held by a handle, preferably being mounted on the body member 12, the handle is held vertically and rotated around its own axis so as pivot the wing parts 14 and 16 away from each other. When the wing parts 14 and 16, due to the centrifugal force, are spaced, the mop pad holder 10 is placed on a plane surface, such as the floor or the mop pad 70, and pressed downward until the locking means lock the wing parts 14 and 16 in the intermediate position or in the operative position.

If the mop pad holder 10 is locked in the operative position, the pedal 40 may be pressed, enabling the mop pad holder 10 to be brought into the intermediate position.

The mop pad holder 10 is then placed on, and aligned with the mop pad 170, guided by the guiding members 174 and 176, so that the eyelets 152, 154, 156, and 158 of the fastening plate 178 are received in the indentations 113, 114, 115, and 116 of the fastening part 50. The mop pad holder 10 is then brought from its intermediate position to the operative position by pressing the body member 12 and the wing parts 14 and 16 further downward towards the mop pad 170 whereby the projections 101 of the fastening plates 178 enter the slots 102 in the fastening parts 50. As described above, this will facilitate a attachment of the mop pad 170 to the mop pad holder 10. The mop pad holder 10, now in the operative position, can then be used for washing and mopping etc.

For bringing the mop pad holder 10 into the collapsed position for washing and wringing of the mop pad 170, one of the pedals 40 is simply pressed whereby the locking means are released and the wing parts 14 and 16 may be brought into the collapsed position. The mop pad 170 can then be washed, wringed or the like.

By then again rotating the handle, the wing parts 14 and 16 will spread, and the mop pad holder 10 may be brought back into the operative position in the way described above.

The mop pad 170 will after a number of washing and wringing/drying operations be ready for replacement. The mop pad holder 10 is then placed in its operative position on the floor, and the two return pedals 184 are pressed down by e.g. a foot whereby the stud members 162, 164, 166, and 168 of the fastening parts 50 of the wing parts 14 and 16 are moved out of engagement with the eyelets 152, 154, 156 and 158 of the fastening plate 178 of the mop pad 170, and the mop pad 170 may be removed from the mop pad holder 10.

The eyelets of the fastening plate 178 may have a shape so that the mop pad 170, due to the stretching of the mop pad 170, after release of the fastening means will be loosely attached to the mop pad holder 10 in a way so that a fast jerk will remove the mop pad 170 from the mop pad holder.

Alternatively, release of the mop pad 170 can also be accomplished when the mop pad holder 10 is in the collapsed position. If a mop pad holder 10 as described in connection with FIGS. 3 and 4 is used, then the return pedals 84 are simply pressed for detachment of the mop pad 70. If a mop pad holder 10 of the type described in connection with FIGS. 5 and 6 is used, one has to press the inner casing 192 partly into to the outer casing 191 to be able to press the return pedal 84 and detach the mop pad 170.

Figure 7:
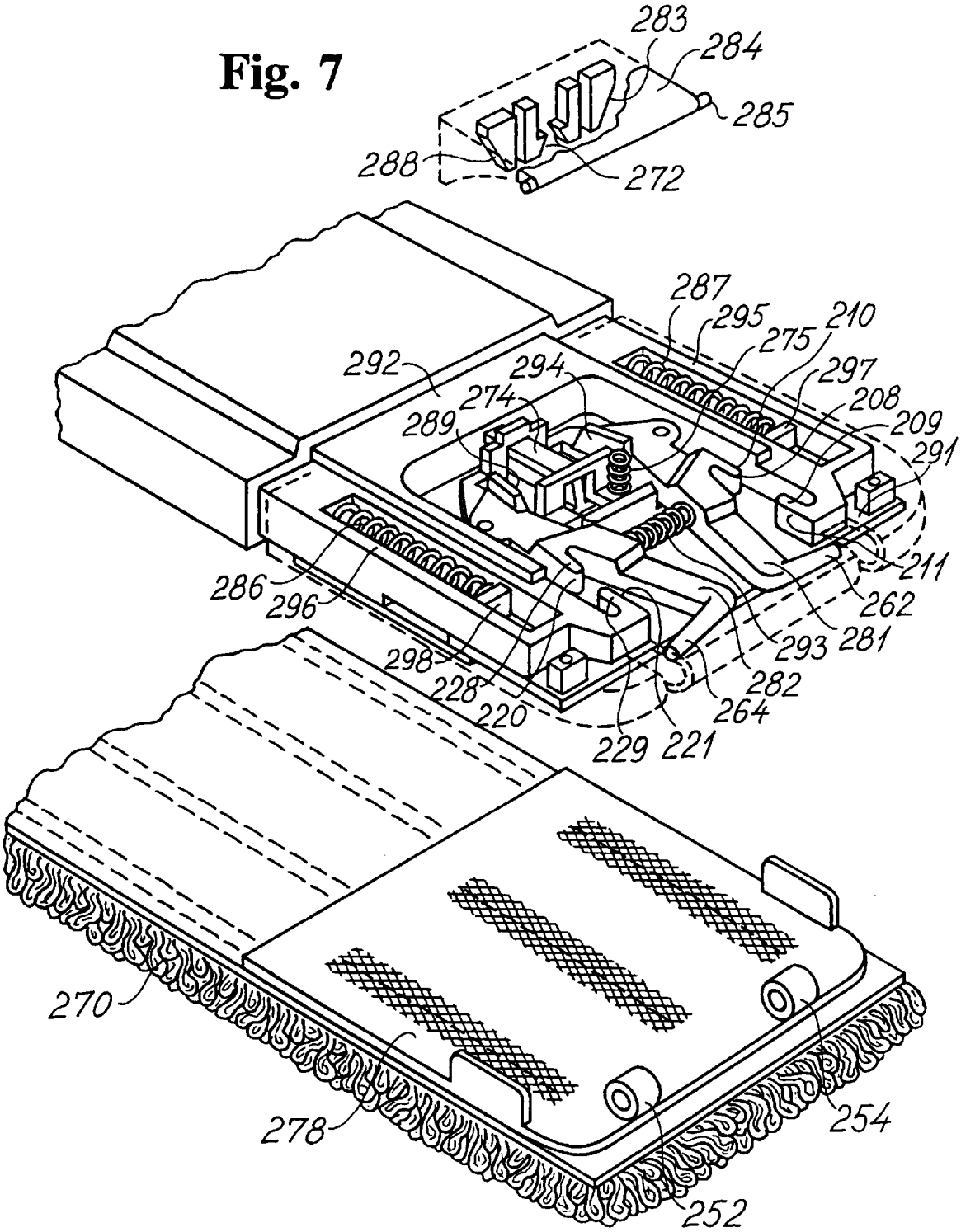
FIG. 7 is an exploded perspective view of part of the mop pad holder having a further embodiment of the fastening means for engaging with the mop pad shown in the open position of the fastening means.
Figure 8:
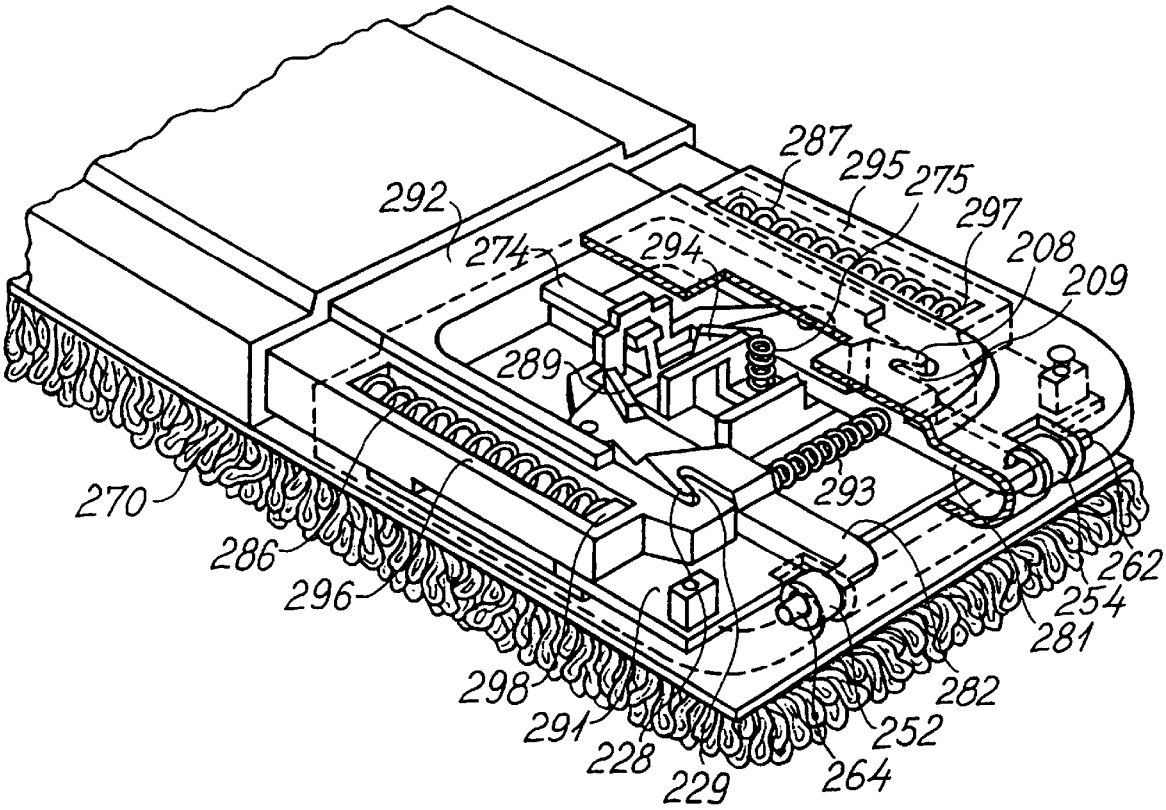
FIG. 8 is a sectional and perspective view showing the fastening means of in FIG. 7 in the fastening position.

FIGS. 7 and 8 show a preferred embodiment of a fastening means according to the invention. Again the numerals have been added 100 compared FIGS. 5 and 6.

In FIG. 7, the fastening means is shown in a perspective view. In this embodiment, the fastening means are provided with two laterally reversed arms 281 and 282 which are provided with stud members 262 and 264, respectively, adapted to engage corresponding eyelets 252 and 254 defined within a fastening plate 278 of a mop pad 270. The arms 281 and 282 are rotatably mounted within, an outer casing 291 in a way so that the arms 281 and 282 may be moved between a closed and an open position. The stud members 262 and 264 are positioned on the arms 281 and 282 so that a spring element 293 provided between the arms 281 and 282 biases the arms towards the closed position. The stud members 262 and 264 are preferably integral parts of the arms 281 and 282.

The arms 281 and 282 are further provided with hook parts 208 and 228, respectively, adapted to engage hook parts 209 and 229 defined within an inner casing 292 so that the arms 281 and 282 are locked in the locking position when the hook parts 208 and 228 engage hook parts 209 and 229 as seen in FIG. 7.

The inner casing 292, complementary to the outer casing 291, extends inside the outer casing 291, and is snap locked to the outer casing 291 in such a manner that displacement of the inner casing 292 is permitted relative to the wing part having the fastening means and in a direction substantially away from the other wing part. The inner casing 292, which preferably is an integral part of the wing part having the fastening means, defines spring-guiding members 295 and 296 guiding spring members 287 and 286, respectively. The spring members 287 and 286 abut in one end towards an end of the spring-guiding members 295 and 296, respectively, and in the other end toward plates 297 and 298, respectively, mounted within the outer casing 291 and displaceable therewith. The spring members 287 and 286 bias the outer casing 291 away from the inner casing 292.

In the open position, outer surface parts 210 and 220 of the hook parts 208 and 228, respectively, abut against outer surface parts 211 and 221 of the hook parts 209 and 229, respectively. The hook parts in this embodiment function much in the same way as in the embodiment described in connection with FIGS. 5 and 6. In this position the spring element 293 in compressed so that the eyelets 252 and 254 may be positioned in the positions in which they may engage the stud members 262 and 264.

To bring the fastening means into the closed position the outer surface parts 210 and 220 of the hook parts 208 and 228, respectively, and the outer surface parts 211 and 221 of the hook parts 209 and 229, should be moved out of abutment. This may be accomplished by pressing the inner casing 292 partly into the outer casing 291 thereby displacing the outer surface parts 210 and 220 in relation to the outer surface parts 211 and 221 so that the spring member 293 may press the arms 281 and 282 away from each other and into the closed position.

In FIG. 8 the fastening means of FIG. 7 is shown in the closed position. It is seen that the spring element 293 presses the arms 281 and 282 away from each other, and that the hook parts 208, 209, 228 and 229 assure that the fastening means stay in the closed position until a detachment of the mop pad 270 is performed.

When bringing the fastening means from the closed position to the open position, so as to detach a mop pad 270 attached to the mop pad holder 10, the inner casing 292 should again be pressed partly into the outer casing 291 so as to provide disengagement of the hook parts 209 and 229 and 208 and 228 respectively. The detachment may then be accomplished by depressing a return pedal 284 being rotatably mounted by means of rods 285 to the outer casing 291. When depressed, cam surface parts 283 and 288 defined on the lower side of the return pedal 284 engage cam surface parts 294 and 289 defined in the arms 281 and 282, respectively. The cam surface parts 294 and 289 are formed on the other side of the rotation axes of the arms 281 and 282 than the stud members 264 and 262, and the cam surface parts 283 and 288 of the return pedal 284 are adapted so that the cam surface parts 294 and 289 are pressed away from each other when the return pedal 284 is depressed.

When having brought the mop pad holder 10 into the collapsed position for e.g. wringing of the mop pad 270, the mop pad 270 should not be able to accidentally be detached by bringing the fastening means into the open position. This is prevented in the same manner as described above by the hook parts 208, 209, 228 and 229 as the spring members 286 and 287 have now brought the outer casing 291 in a position where the hook parts engage.

When detaching a mop pad 270 from the mop pad holder 10, the arms 281 and 282 would, due to the spring member 293, be pressed back into the closed position when the return pedal 284 is released. It is, however, preferred that the arms 281 and 282 stay in the open position after detachment of a mop pad 270. This is facilitated by providing means for holding the return pedal 284 depressed until the outer casing 291 is moved to a position in which the outer surface parts 210 and 220 and 211 and 221 are able to engage when the return pedal 284 is released so as to keep the arms 281 and 282 in the open position.

In this embodiment, this is accomplished by providing the pedal 284 with snap lock means 272 able to lock onto a track 274 when the return pedal 284 is depressed so as to hold the return pedal 284 depressed until the outer casing 291 has been displaced a certain distance in relation to the inner casing 292 so that the outer surface parts 210, 220, 211 and 221 may engage. The track 274 is preferably formed in the inner casing 292 so that when the outer casing 291 is displaced in relation to the inner casing 292, the snap lock means 272 of the return pedal 284 are displaced along the track 274. When the snap lock means 272 are moved beyond an end of the track 274, the pedal 284 is released and may, due to a spring member 275, return to its not-depressed position. The length of the track 274 is defined so that the return pedal 284 is not released until the outer surface parts 210, 220, 211 and 221 are able to engage and thereby hold the arms 281 and 282 in the open position.

Figure 11:
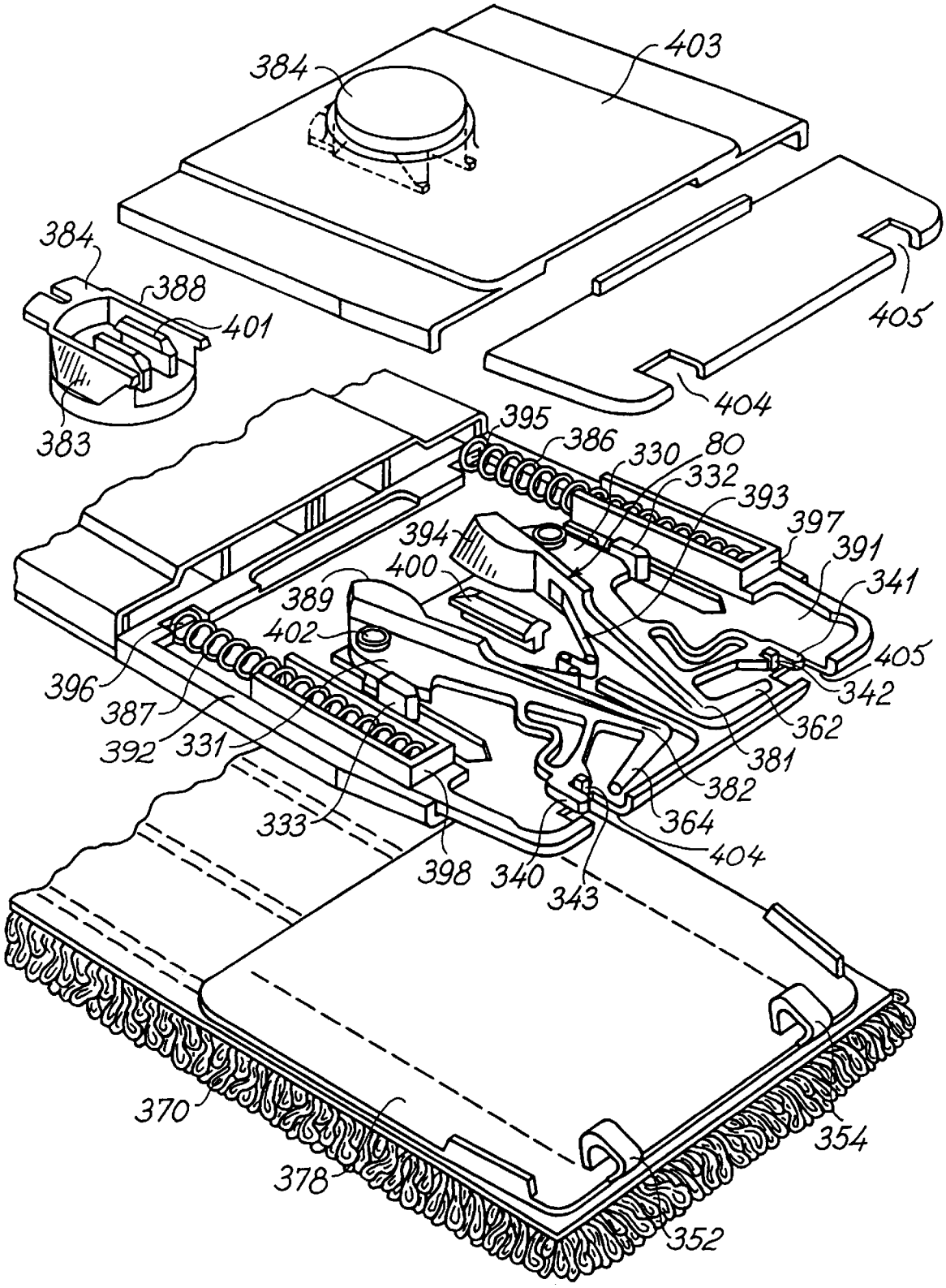
FIG. 11 is an exploded perspective view of part of the mop pad holder showing a further, preferred embodiment of the fastening means for releasably interconnecting the mop pad and the wing part, shown in the open position of the fastening means.
Figure 12:
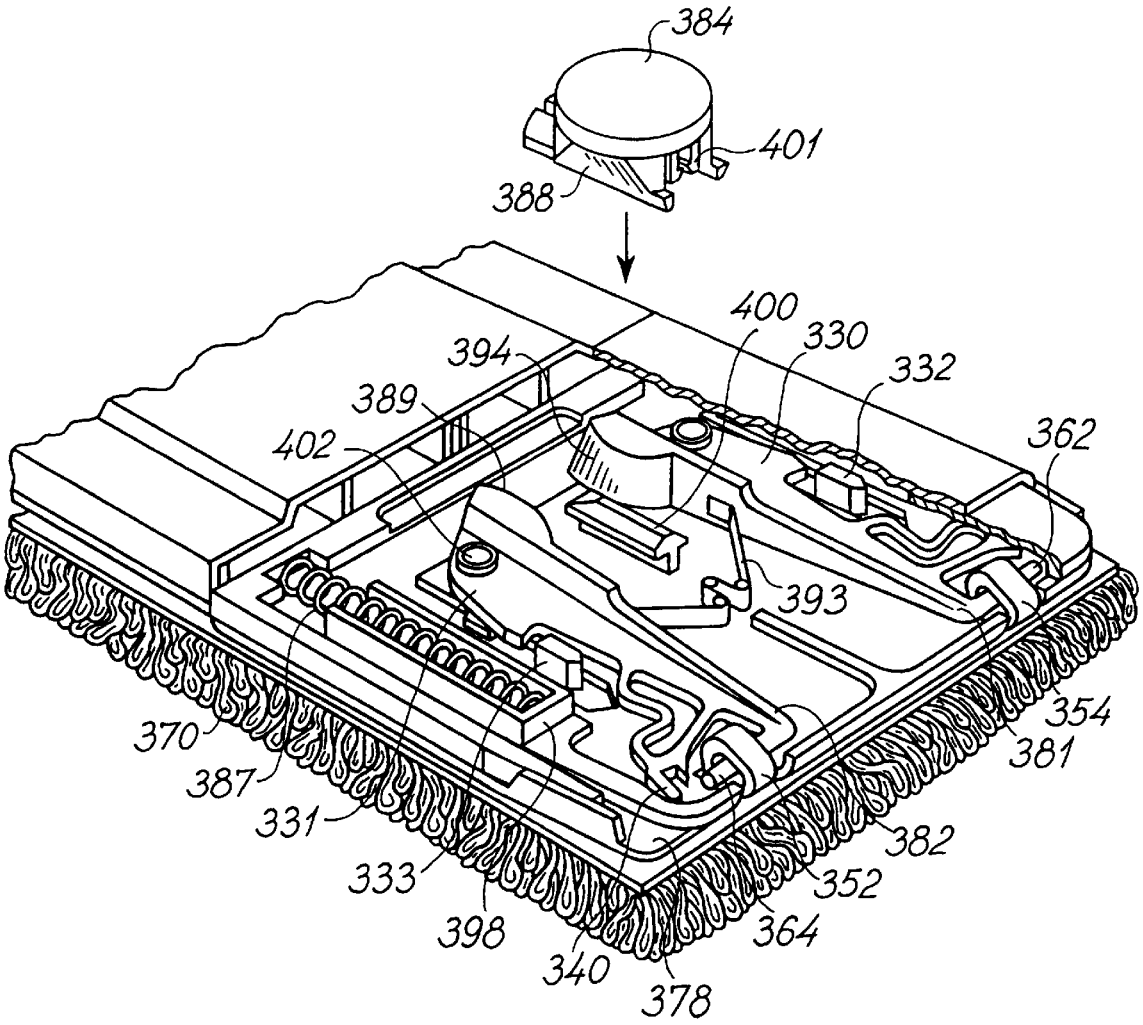
FIG. 12 is a sectional and perspective view of part of the mop pad holder shown in FIG. 11 wherein the fastening means are in their fastening position.

FIGS. 11 and 12 show another embodiment of the fastening means illustrated in FIGS. 7 and 8 and corresponding parts have been provided with the same reference numerals increased by 100.

In FIG. 11 the fastening means comprise a pair of laterally reversed levers or arms 381 and 382 which at their free ends are provided with stud members 362 and 364, respectively, adapted to engage with corresponding eyelets or hole members 352 and 354 formed integrally with a relatively stiff fastening plate 378 fastened to each end portion of a mop pad 370. The arms 381 and 382 are pivotably mounted on a displaceable mounting plate 391 in such a manner that the arms 381 and 382 may be moved between a closed and an open position. The stud members 362 and 364 are biased towards their closed position by a leaf spring 393 mounted between the arms 381 and 382. The stud members 362 and 364 are preferably formed integrally with the arms 381 and 382.

The arms 381 and 382 are further provided with hook parts 340 and 341, respectively, adapted to engage with studs 342 and 343 extending from the mounting plate 391 so that the arms 381 and 382 are locked in their open position when the hook parts 340 and 341 engage with the studs 342 and 343 as shown in FIG. 11. Furthermore, cam surfaces 330 and 331 defined on the arms are adapted to engage with cam follower studs 332 and 333, respectively, extending from an adjacent wing part wall surface 392 so that the arms are locked in their open position when the cam surfaces 330 and 331 engage with the studs 332 and 333, namely when the mounting plate 391 has been moved to its outer position in relation to the wall surface 392.

The mounting plate 391 may be displaced between an inner and an outer position in relation to the wall surface 392 of the wing part. A pair of spiral springs 386 and 387 are biassing the displaceable mounting plate 391 towards its outer position. One end position of each of the springs is received in a channel member 397 and 398, respectively, formed on the displaceable mounting plate 391, and the other end of each of the springs 386 and 387 is in abutting engagement with an abutment surface 395 and 396, respectively, defined on the stationary wing part.

When the mop pad 370 is to be fastened to the mop pad holder the hook parts 362 and 364 of the fastening means are pressed against the studs 342 and 343, respectively. As indicated in FIG. 14, this is obtained by pressing the mop pad holder downwardly towards the mop pad when the mop pad holder is in its intermediate position. The downward pressure will cause the hook parts 340 and 341 to be pressed outwardly against the eyelets 352 and 354, respectively, of, FIG. 11. Because the hook parts 340 and 341 are resiliently mounted on their respective arms they are moved out of engagement with the studs 342 and 343. However, the arms 381 and 382 are still locked in their open position due to the engagement of the cam surfaces 330 and 331 with the studs 332 and 333, respectively. To bring the arms 381 and 383 into locking engagement with the eyelets 352 and 354 the fastening means and the mounting plate 391 has to be pressed further inwardly to bring the cam surfaces 330 and 331 out of engagement with the studs 332 and 333, so as to allow the spring 393 to move the arms 381 and 382 to their closed position in which the stud members 362 and 364 are engaging with the eyelets 352 and 354.

In FIG. 12 the fastening means illustrated in FIG. 11 are shown in their closed position with the mop pad 370 mounted on the mop pad holder 10.

The fastening means may be moved from their closed to their open position for releasing the mop pad 370 from the mop pad holder 10 by depressing a return pedal or knob 384, which extends through an opening in an upper wing part wall 403 as best shown in FIG. 11. The pedal or knob 384 is slidably connected to the displaceable mounting plate 391, for example by means of a longitudinally extending tongue 400 being formed integrally with the mounting plate 391 and having an arrow-shaped cross-section and a channel member 401 having a complementary cross-sectional shape and being formed integrally with the pedal or knob 384 of its bottom side. Cam surface parts 383 and 388 defined on the bottom side of the pedal 384 are in engagement with corresponding cam surface parts 394 and 389 defined on the arms 381 and 382, respectively. The cam surface parts 394 and 389 are located oppositely to the stud members 364 and 362 in relation to the pivots or axes of rotation 402 of the arms 381 and 382. The cooperating cam surface parts are shaped so that depression of the pedal 384 causes the levers or arms 381 and 382 to be moved to their open position against the bias of the spring member 393. Because the hook parts 340 and 341 are resiliently mounted they are forced into engagement with the studs 342 and 343 whereby the levers or arms 381 and 382 are retained in their open, mop pad releasing position against the bias of the spring member 393.

A mop pad holder 10 according to the embodiment described in FIGS. 7 and 8 may be operated in the same manner as the mop pad holders 10 according to the previously described embodiments. As is the case in the embodiment of a mop pad holder 10 described in connection with FIGS. 5 and 6, the mop pad 270 may not be accidentally detached during e.g. wringing as the mop pad 270 may only be detached when the mop pad holder 10 is in the operational position or the inner casing 292 is pressed partly into the outer casing 291.

For the preferred embodiments simpler fastening plates 278, 378 are required for the mop pads 270. These fastening plates 278, 378 only comprise 1–10, such as 1–5, preferably 1–3, such as 2 eyelets and no projections to enter slots in the fastening means. In the embodiment of a mop pad holder 10 described in connection with FIGS. 5 and 6, typically in the order of 4 eyelets and one projection are required. In the preferred embodiments, less accuracy is required when attaching the mop pad 270, 370 to the mop pad holder 10.

Furthermore, even though the fastening means may be of a more complex nature, the large number of simpler fastening plates 278, 378 on the mop pads 270, 370 used during the life of a mop pad holder 10 will reduce the total expenses of a mop in the long run.

FIGS. 13 and 14 illustrate how a mop pad 370 may be mounted to the mop pad holder 10. The mop pad is placed flat on the floor with the eyelets 352 and 354 facing upwardly. By pressing pedal or button 40 the locking means 18 are released so that one of the wing parts 14 may pivot to a depending position shown in FIG. 13. The hook parts 362 and 364 are partly exposed in cut outs or recesses 404 and 405 formed in the outer ends of the wing parts 14 and 16, as indicated in FIG. 11. Now, the mop pad holder is positioned as shown in FIG. 14 so that each of the eyelets 352 and 354 is received in a corresponding recess 404 and 405 so that the eyelets come into engagement with the exposed hook parts 362 and 364. The central body member 12 of the mop pad holder is now exposed to a downwardly directed pressure through the handle of the mop pad holder. This cause each of the eyelets 352 and 354 to be pressed inwardly against the corresponding hook part 362 and 364 whereby the hook parts are moved out of engagement with studs 342 and 343. Simultaneously, the displaceable mounting plate 391 is pushed inwardly against the bias of the springs 386 and 387, whereby the cam surfaces 330 and 331 are moved out of engagement with the studs 332 and 333. Thereafter, the arms 381 and 382 are swung outwardly into their closed position under the bias of the spring member 393. This means, that the stud members 362 and 364 are moved into engagement with the eyelets 352 and 354 whereby the mop pad 370 is securely fastened to the mop pad holder. When the mop pad 370 is to be replaced the pedals or buttons 384 and 407 are depressed whereby the levers or arms 381 and 382 are moved back to their open position as explained above, and the mop pad 370 is released. If a mop pad 370 is to be wringed while it is mounted to the mop pad holder the pedal or button 38 may be depressed. Both wing parts 14 and 16 of the mop pad holder 10 will then depend from the central body member 12 and the mop pad 370 will depend from the ends of the wing parts in a U-shape.

The inner section of each wing part may define an inner space which may be closed by a screw cap or another sealable closure. Water or another weight increasing substance may then be filled into the closable space or spaces whereby the weight of the mop pad holder may be adjusted as desired.

It will be obvious to a person skilled in the art that numerous embodiments of mop pad holders and mop pads are covered by the inventive idea of this invention. The main principles of this invention may be used in a wide variety of locking means also for use in other means than mop pad holders.

I claim:

1. A collapsible map pad holder (10) comprising a body member (12), at least first and second wing parts (14, 16) each pivotally connected to the body member (12) so as to be pivotable between an operative position in which the body member (12) and the wing parts (14, 16) define a surface for supporting a mop pad, and an inoperative position in which each of the wing parts (14, 16) depends from the body member (12), first and second locking means (18, 20) for locking the first and second wing parts (14, 16), respectively is relation to the body member (12) in the operative positions of the wing parts, a pair of first latch members, each of said first and second locking means (18, 20) comprising a respective one of said first latch members (22, 23), each of said first latch members being moveable between a locking position, in which it is in locking engagement with the respective wing part (14, 16) in its operative position, and a releasing position, a locking element (24; 24*a*, 24*b*) having the first latch members (22, 23) arranged thereon being movably mounted on the body member (12) so as to be movable in relation thereto, first actuating means (30) for moving the locking element so as to move the first latch members (22, 23) between their locking and releasing positions, activating means selected from the group consisting of:

second latch members (22, 23) for locking each of the first and second wing parts (14, 16) in an intermediate position between the operative position and the inoperative position of the respective wing part (14, 16), and a second actuating means (30) adapted to move only one of said first latch members (22, 23) to its releasing position when actuated.

2. The mop pad holder according to claim 1, wherein the first and second actuating means (30) are adapted to impart different movements to the locking element (24; 24*a*, 24*b*) when actuated.

3. The mop pad holder according to claim 1, wherein the second latch members (22, 23) are arranged on the locking element (24; 24*a*, 24*b*) so as to be moveable therewith, whereby each of the second latch members (22, 23) may be moved from a releasing position into a locking position for locking the respective wing part (14, 16) in its intermediate position.

4. The mop pad holder according to claim 3, wherein the first and a second latch members (22,23) are formed integrally with the locking element (24; 24*a*, 24*b*).

5. The mop pad holder according to claim 1, wherein the locking element (24; 24*a*, 24*b*) is mounted rotatably on the body member (12), the locking element thereby defining a rotational axis.

6. The mop pad holder according to claim 5, wherein the latch members (22, 23) are moved between their locking and releasing positions by rotational movement of the locking element (24; 24*a*, 24*b*).

7. The mop pad holder according to claim 6, wherein the first latch members (22, 23) may be moved between their releasing and locking positions by rotating the locking element (24; 24*a*, 24*b*) through predetermined first and second angles, respectively.

8. The mop pad holder according to claim 7, wherein said first and second angles are substantially the same.

9. The mop pad holder according to claim 8, wherein said first angle exceeds said second angle.

10. The mop pad holder according to claim 9, wherein the locking element (24; 24*a*, 24*b*) may be rotated through different angles corresponding to said first and second angles by actuating the first and second actuating means (30), respectively.

11. The mop pad holder according to claim 5, wherein the first and the second locking means (18, 20) are arranged at substantially the same distance from the axis of rotation of the locking element (24; 24*a*, 24*b*).

12. The mop pad holder according to claim 5, wherein the first latch members (22, 23) are arranged at substantially the same distance from the axis of rotation of the locking element (24; 24*a*, 24*b*).

13. The mop pad holder according to claim 5, wherein the first and second actuating means (30) define cam surface parts (31 ) cooperating with corresponding cam surface parts (33) defined by the locking element (24; 24*a*, 24*b*) so as to rotate the locking element (24; 24*a*, 24*b*) and the latch members (22, 23) arranged thereon towards their releasing positions when any of the first and second actuating means (30) is actuated.

14. The mop pad holder according to claim 5, wherein said first latch members (22, 23) are positioned substantially diametrically oppositely to the rotational axis of the locking element (24; 24*a*, 24*b*).

15. The mop pad holder according to claim 5, wherein two of said second latch members (22, 23) are positioned substantially diametrically oppositely to the rotational axis of the locking element (24; 24*a*, 24*b*).

16. The mop pad holder according to claim 1, wherein the locking element (24; 24*a*, 24*b*) is spring-biased towards the locking position of the latch members (22, 23).

17. A combination of a collapsible mop pad holder (10) and a mop pad (70; 170; 270; 370), said collapsible mop pad holder (10) having a body member (12) and at least one wing part (14; 16) pivotally connected to the body member (12) so as to be pivotable between an operative position in which the body member (12) and the wing part (14; 16) define a surface for supporting said mop pad (70; 170; 270; 370), and an inoperative position in which the wing part depends from the body part (12), said surface defining opposite surface end portions, said mop pad (70; 170; 270; 370) being mounted on the mop pad holder (10) and being supported by said supporting surface, said mop pad defining opposite mop pad end portions (71; 171) and a longitudinal axis, said combination comprising one or more fastening means for fastening each of said opposite mop pad end portions to the mop pad holder, said fastening means defining a pivot axis extending transversely to said longitudinal axis of the mop pad, whereby the mop pad may rotate about said pivot axis in relation to the mop pad holder (10) when the wing part (14; 16) is moved between its operative and inoperative positions, each of said fastening means comprising a first group of fastening means consisting of bore-defining means (52, 54, 56, 58; 152, 154, 156, 158; 252, 254; 352, 354), and a second group of fastening means consisting of stud members (62, 64, 66, 68; 162, 164, 166, 168; 264, 262; 362, 364) for engagingly cooperating with said bore-defining means, said stud members being complementary to said bore-defining means, one of said first and second group of fastening means being fixed on said mop pad end portions and the other one of said first and second group of fastening means being fixed on said surface end portions of the mop pad holder, the mop pad end portions being adjacent to the surface end portions, the bore-defining means and stud members being adapted to be brought into and out of locking interengagement.

the combination further comprising motion means connected to the mop pad holder (10) for moving the bore-defining means and the stud members into and out of interengagement when actuated.

18. The combination according to claim 17, wherein the bore-defining means and the stud members fixed on the mop pad holder are axially displaceable with respect to said pivot axis.

19. The combination according to claim 18, wherein the stud members and the bore-defining means are axially spaced.

20. The combination according to claim 17, wherein the stud members and the bore-defining means fixed on the mop pad holder are rotatably displaceable.

21. The combination according to claim 17, wherein the bore-defining means are an integral part of the mop pad and the stud members are an integral part of the mop pad holder.

22. The combination according to claim 17, wherein the bore-defining means are an integral part of the mop pad holder and the stud members are an integral part of the mop pad.

23. The combination according to claim 17, further comprising blocking means (72) for blocking the movement of the motion means.

24. The combination according to claim 17, wherein the mop pad holder (10) comprises outer casings (91; 191; 291) and inner casing (92; 192; 292) mutually displaceable in a telescopic manner so that the length of the mop pad holder (10) may be adjusted.

25. The combination according to claim 17, wherein the motion means comprises a spring-biased motion element (93; 193; 293; 393), said combination further comprising actuating means for activating said motion element so as to allow the motion element (82; 182; 281; 381, 382) to be displaced into a fastening position, wherein the bore-defining means and the stud members are in interengagement.

26. The combination according to claim 17, wherein the bore-defining means are projecting eyelets.

27. A mop pad holder (10) for use in a combination comprising said mop pad holder and a mop pad (70; 170; 270; 370), said mop pad holder comprising a body member (12), at least first and second wing parts (14, 16) each pivotally connected to the body member (12) so as to be pivotable between an operative position in which the body member (12) and the wing parts (14, 16) define a surface for supporting said mop pad, and an inoperative position in which the wing parts (14, 16) depend from the body part, said surface defining opposite surface end portions, and first and second locking means (18, 20) for locking the first and second wing parts (14, 16), respectively, in relation to the body member (12) in the operative position of the wing parts (14, 16), said mop pad (70; 170; 270; 370) being mounted on the mop pad holder (10) and being supported by said supporting surface, said mop pad defining opposite mop pad end portions (71; 171) and a longitudinal axis, said combination further comprising one or more fastening means for fastening each of said opposite mop pad end portions to the mop pad holder, said fastening means defining a pivot axis extending transversely to said longitudinal axis of the mop pad, whereby the mop pad may rotate about said pivot axis in relation to the mop pad holder (10) when the wing part (14; 16) is moved between its operative and inoperative positions, each of said fastening means comprising a first group of fastening means consisting of bore-defining means (52, 54, 56, 58; 152, 156, 158; 252, 254; 352, 354) and a second group of fastening means consisting of stud members (62, 64, 66, 68; 162, 164, 166, 168; 264, 262; 362, 364) for engagingly cooperating with said bore-defining means, said stud members being complementary to said bore-defining means, one of said first and second group of fastening means being fixed on said mop pad end portions and the other one of said first and second group of fastening means being fixed on said surface end portions of the mop pad holder, the mop pad end portions being adjacent to the surface end portions, the bore-defining means and stud members being adapted to be brought into and out of locking interengagement, the mop pad holder (10) further comprising motion means for moving the bore-defining means and the stud members into and out of interengagement when actuated.

28. The mop pad holder according to claim 27, further comprising a pair of first latch members, each of said first and second locking means (18, 20) comprising a respective one of said first latch members (22, 23), each of said first latch members being moveable between a locking position, in which it is in locking engagement with the respective wing part (14, 16) in its operative position, and a releasing position.

29. The mop pad holder according to claim 27, further comprising a locking element (24; 24*a*, 24*b*) having the first latch members (22, 23) arranged thereon being movably mounted on the body member (12) so as to be movable in relation thereto.

30. The mop pad holder according to claim 29, further comprising first actuating means (30) for moving the locking element (24; 24*a*, 24*b*) so as to substantially simultaneously move the first latch members (22, 23) between their locking and releasing positions.

31. The mop pad holder according to claim 29, wherein the first and second actuating means (30) are adapted to impart different movements to the locking element (24; 24*a*, 24*b*) when actuated.

32. The mop pad holder according to claim 29, wherein the first and second latch members (22, 23) are formed integrally with the locking element (24; 24*a*, 24*b*).

33. The mop pad holder according to claim 29, wherein the locking element (24; 24*a*, 24*b*) is mounted rotatably on the body member (12), said locking element thereby defining a rotational axis.

34. The mop pad holder according to claim 33, wherein the first and second latch members (22, 23) are moved between their locking and releasing positions by rotational movement of the locking element (24; 24*a*, 24*b*).

35. The mop pad holder according to claim 34, wherein the first latch members (22, 23) may be moved between their releasing and locking positions by rotating the locking element (24; 24*a*, 24*b*) through predetermined first and second angles, respectively.

36. The mop pad holder according to claim 35, wherein said first and second angles are substantially the same.

37. The mop pad holder according to claim 36, wherein said first angle exceeds said second angle.

38. The mop pad holder according to claim 37, wherein the locking element (24; 24*a*, 24*b*) may be rotated through different angles corresponding to said first and second angles by actuating the first and second actuating means (30), respectively.

39. The mop pad holder according to claim 29, wherein the locking element (24; 24*a*, 24*b*) is spring-biased towards the locking position of the latch members (22, 23).

40. The mop pad holder according to claim 29, further comprising a plurality of second latch members (22, 23) for locking each of the first and second wing parts (14, 16) in an intermediate position between the operative position and the inoperative positions of the respective wing part (14, 16).

41. The mop pad holder according to claim 40, wherein the second latch members (22, 23) are arranged on the locking element (24; 24*a*, 24*b*) so as to be moveable therewith, whereby each of the second latch members (22, 23) may be moved from releasing position into a locking position for locking the respective wing part (14, 16) in its intermediate position.

42. The mop pad holder according to claim 27, further comprising second actuating means (30) adapted to move only one of said first latch members (22, 23) to its releasing position when actuated.

43. The mop pad holder according to claim 27, further comprising a plurality of second latch members (22, 23) for locking each of the first and second wing parts (14, 16) in an intermediate position between the operative position and the inoperative position of the respective wing part (14, 16).

44. The mop pad holder according to claim 33, wherein the first and the second locking means (18, 20) are arranged at substantially the same distance from the axis of rotation of the locking element (24; 24*a*, 24*b*).

45. The mop pad holder according to claim 33, wherein each of the first latch members (22, 23) are arranged at substantially equal distances from the axis of rotation of the locking element (24; 24*a*, 24*b*).

46. The mop pad holder according to claim 33, wherein the first and second actuating means (30) define cam surface parts (31) cooperating with corresponding cam surface parts (33) defined by the locking element (24; 24*a*, 24*b*) so as to rotate the locking element and the first and second latch members (22, 23) arranged thereon towards their releasing positions when any of the first and second actuating means (30) is actuated.

47. The mop pad holder according to claim 33, wherein the first latch members (22, 23) are positioned substantially diametrically oppositely to the rotational axis of the locking element (24; 24*a*, 24*b*).

48. The mop pad holder according to claim 33, wherein two of said second latch members (22, 23) are positioned substantially diametrically oppositely to the rotational axis of the locking element (24; 24*a*, 24*b*).

49. A mop pad (70; 170; 270; 370) for use in a combination comprising said mop pad and a collapsible mop pad holder (10), said collapsible mop pad holder (10) having a body member (12) and at least one wing part (14; 16) pivotally connected to the body member (12) so as to be pivotable between an operative position in which the body member (12) and the wing part (14; 16) define a surface for supporting said mop pad (70; 170, 270; 370), and an inoperative position in which the wing part depends from the body party (12), said surface defining opposite surface end portions, said mop pad (70; 170; 270; 370) being adapted to be mounted on the mop pad holder (10) and being supported by said supporting surface, said mop pad defining opposite mop pad end portions (71; 171) and a longitudinal axis, said combination comprising one or more fastening means for fastening each of said opposite end portions of the mop pad to the mop pad holder, said fastening means defining a pivot axis extending transversely to said longitudinal axis of the mop pad, whereby the mop pad may rotate about said pivot axis in relation to the mop pad holder (10) when the wing part (14; 16) is moved between its operative and inoperative positions, each of said fastening means comprising a first group of fastening means consisting of bore-defining means (52, 54, 56, 58; 152, 156, 158; 252, 254; 352, 354), and a second group of fastening means consisting of stud members (62, 64, 66, 68; 162, 164, 166, 168; 264, 262; 362, 364) for engagingly cooperating with said bore-defining means, said stud members being complementary to said bore-defining means, one of said first and second group of fastening means being fixed on said mop pad end portions and the other one of said first and second group of fastening means being fixed on said surface end portions of the mop pad holder, the mop pad end portions being adjacent to the surface end portions, the bore-defining means and stud members being adapted to be brought into and out of locking interengagement, the combination further comprising motion means connected to the mop pad holder (10) for moving the bore-defining means and the stud members into and out of interengagement when actuated, said mop pad comprising at each of said end portions (71; 171) first pivot axis defining means (52, 54, 56, 58; 152, 154, 156, 158; 252, 254; 352, 354), said mop pad holder comprising second pivot axis defining means (62, 64, 66, 68; 162, 164, 166, 168; 264, 262; 364, 366), said first pivot axis defining means being adapted to engagingly cooperating with said second pivot axis defining means, the first and second pivot axis defining means being adapted to cooperate so as to define in combination a pivot axis extending transversely to the longitudinal axis of the mop pad and allowing mutual pivotal movement of the mop pad holder and the mop pad when the mop pad is mounted on the mop pad holder.

each of the opposite mop pad end portions (71; 171) comprising the first pivot axis defining means being relatively stiff.

50. The mop pad according to claim 49, wherein the first pivot axis defining means comprise bore defining means.

51. The mop pad according to claim 50, wherein the bore-defining means are in the form of eyelet projecting from the mop pad.

52. The mop pad according to claim 50, wherein a relatively stiff plate member (78; 178; 278) is attached to each of said end portions of the mop pad, and wherein the bore defining means are formed integrally with the plate member (78; 178; 278).

53. The mop pad according to claim 49, wherein a relatively stiff plate member (78; 178; 278) is attached to each of said end portions of the mop pad.

* * * * *

UNITED STATES PATENT AND TRADEMARK OFFICE

CERTIFICATE OF CORRECTION

PATENT NO. : 5,836,039

DATED : November 17, 1998

INVENTOR(S) : Alf Rimer

It is certified that error appears in the above-indentified patent and that said Letters Patent is hereby corrected as shown below:

On the title page, item [75]

should read: Alf Rimer, Herlev, Denmark.

Signed and Sealed this

Third Day of August, 1999

*Attest:*

Q. TODD DICKINSON

*Attesting Officer*

*Acting Commissioner of Patents and Trademarks*